US005081400A

United States Patent [19]

Weber et al.

[11] Patent Number: 5,081,400

[45] Date of Patent: Jan. 14, 1992

[54] POWER EFFICIENT SUSTAIN DRIVERS AND ADDRESS DRIVERS FOR PLASMA PANEL

[75] Inventors: Larry F. Weber; Kevin W. Warren, both of Champaign, Ill.; Mark B. Wood, Woods Cross, Utah

[73] Assignee: The Board of Trustees of the University of Illinois, Urbana, Ill.

[21] Appl. No.: 338,111

[22] Filed: Apr. 14, 1989

Related U.S. Application Data

[63] Continuation of Ser. No. 911,396, Sep. 25, 1986, Pat. No. 4,866,349.

[51] Int. Cl.[5] ..... G09G 3/10; G09G 3/22; G09G 3/28

[52] U.S. Cl. ..... 315/169.4; 315/169.3; 340/776

[58] Field of Search ..... 315/169.1, 169.3, 169.4, 315/108, 109; 340/776, 777, 778

[56] References Cited

U.S. PATENT DOCUMENTS

| | | | |
|---|---|---|---|
| 4,496,879 | 1/1985 | Suste | 315/169.4 |
| 4,866,349 | 9/1989 | Weber et al. | 315/169.4 |
| 4,924,218 | 5/1990 | Weber et al. | 315/169.4 |

OTHER PUBLICATIONS

H. Tottori, E. Hatabe, F. Isogai and S. Yoshida, "A Driving Circuit for Plasma Display Panels", *Society for Information Display, SID 75 Digest,* vol. 6, pp. 118–119, Apr. 1975.

W. E. Johnson, E. A. Oster and H. J. Hoehn, "Plasma Display/Memory Panel with Integral Drive Circuitry", *Society for Information Display, SID 77 Digest,* vol. 8, pp. 20–21, Apr. 1977.

M. L. Higgins, "A Low-Power Drive Scheme for AC TFEL Displays", *Society for Information Display, SID 85 Digest,* vol. 16, pp. 226–228, Apr.–May 1985.

*Primary Examiner*—Eugene R. Laroche
*Assistant Examiner*—Michael B. Shingleton
*Attorney, Agent, or Firm*—Marshall, O'Toole, Gerstein, Murray and Bicknell

[57] ABSTRACT

An improved address driver circuit for plasma panels, particularly useful with an independent sustain and address plasma panel. Address pulse generators for one panel address axis are coupled to MOSFET driver devices and provide pulses of a first polarity; and address pulse generators for the other panel address axis are coupled to similar MOSFET driver devices and provide double pulses of a second polarity. With N-channel open-drain MOSFET drivers on both panel address axes, they only need to be designed to pull low. An improved power efficient sustain driver for plasma panels including an inductor through which the panel capacitance is charged and discharged, and switch means switched when the inductor current is zero, which permits recovery of the energy otherwise lost in driving the panel capacitance. An independent sustain and address plasma panel with such energy efficient address drivers and sustain drivers. The energy efficient sustain driver can be used with plasma display panels, electroluminescent panels and with liquid crystal panels having inherent panel capacitance. An independent sustain and address panel with N-channel MOSFET drivers on one address axis and P-channel MOSFET drivers on the other address axis, with an address pulse generator providing pulses of a first polarity to the N-channel MOSFETs, and another address pulse generator providing pulses of a second polarity to the P-channel MOSFETS.

41 Claims, 8 Drawing Sheets

FIG. 8
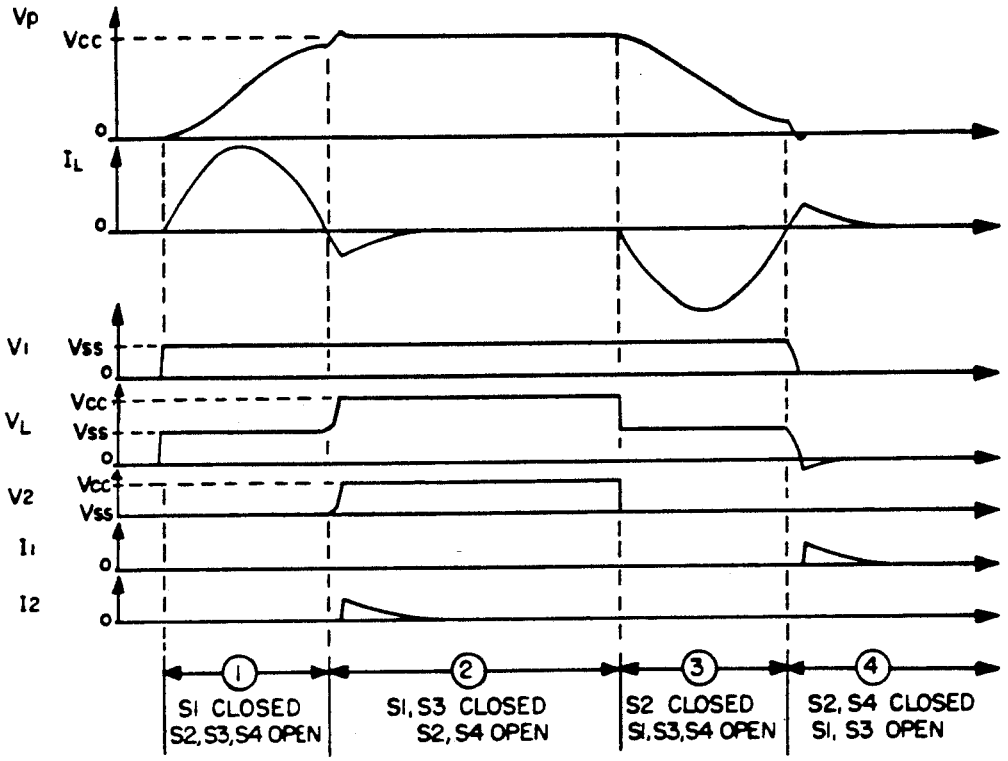
FIG. 9
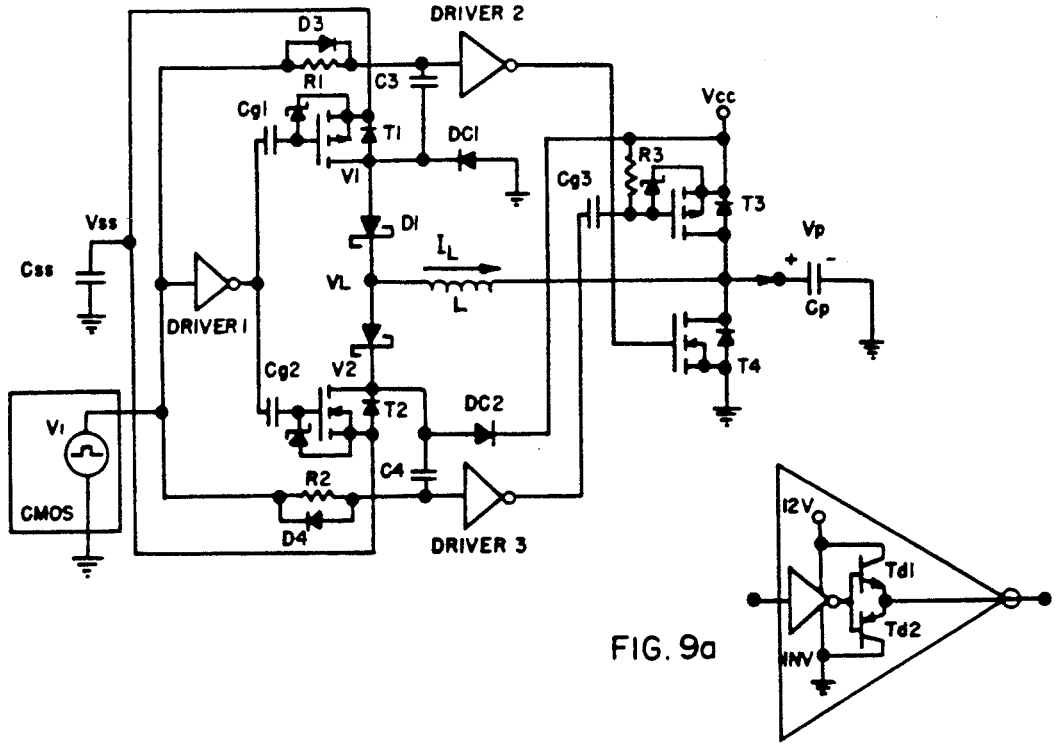
FIG. 9a

POWER EFFICIENT SUSTAIN DRIVERS AND ADDRESS DRIVERS FOR PLASMA PANEL

This is a continuation of application Ser. No. 6/911,396, filed Sept. 25, 1986 now U.S. Pat. No. 4,866,349 issued Sept. 12, 1989.

This invention relates to plasma panels and to improvements in address driver circuits and sustain driver circuits for plasma display panels, particularly for independent sustain and address plasma display panels.

BACKGROUND OF THE INVENTION

Plasma display panels, or gas discharge panels, are well known in the art and, in general, comprise a structure including a pair of substrates respectively supporting thereon column and row electrodes each coated with a dielectric layer such as a glass material and disposed in parallel spaced relation to define a gap therebetween in which an ionized gas is sealed. Moreover, the substrates are arranged such that the electrodes are disposed in orthogonal relation to one another thereby defining points of intersection which in turn define discharge cells at which selective discharges may be established to provide a desired storage or display function. It is also known to operate such panels with AC voltages and particularly to provide a write voltage which exceeds the firing voltage at a given discharge point, as defined by a selected column and row electrode, thereby to produce a discharge at a selected cell. The discharge at the selected cell can be continuously "sustained" by applying an alternating sustain voltage (which, by itself is insufficient to initiate a discharge). This technique relies upon the wall charges which are generated on the dielectric layers of the substrates which, in conjunction with the sustain voltage, operate to maintain discharges.

Details of the structure and operation of such gas discharge panels or plasma displays are set forth in U.S. Pat. No. 3,559,190 issued Jan. 26, 1971 to Donald L. Bitzer, et al.

In the past two decades, AC plasma displays have found widespread use due to their excellent optical qualities and flat panel characteristics. These qualities have made plasma displays a leader in the flat-panel display market. However, plasma panels have gained only a small portion of their potential market because of competition from lower costs CRT products.

The expense of the display electronics, not the display itself, is the most significant cost factor in plasma displays. Because of the matrix addressing schemes used, a separate voltage driver is required for each display electrode. Therefore, a typical 512×512 pixel display requires a total of 1024 electronic drivers and connections which add considerable bulk and cost to the final product.

In a co-pending U.S. patent application Ser. No. 787,541 filed Oct. 15, 1985, and assigned to the same assignee as herein, there is described an Independent Sustain and Address (ISA) plasma panel. Also, see the publication L. F. Weber and R. C. Younce, "Independent Sustain And Address Technique For The AC Plasma Display", 1986 *Society For Information Display International Symposium Conference Record*, pp. 220–223, San Diego, May, 1986. The ISA plasma panel technique includes the addition of an independent address electrode between the sustain electrodes. These address electrodes are then connected to the address drivers. The sustain electrodes can be bused together and connected directly to the sustainers.

The ISA plasma panel offers two significant advantages. First, since the address electrodes do not have to deliver the large sustain current to the discharging pixels, the address drivers have low current requirements. This allows lower cost drivers to be used. The second advantage is that only half the number of address drivers are needed since one address electrode can serve the sustain electrode on either side.

Despite the significant advantages afforded by the ISA panel, it is still desired to reduce as much as possible the manufacturing cost of such panels. However, while the ISA panel has enabled a reduction of the address drivers of a typical 512×512 pixel display from 1024 electronic address drivers to only 512 drivers, this is still a significant number of required electronic components. In fact, the plasma panel cost is dominated by the cost of the associated required electronic circuits such as the addressing river circuits and sustain driver circuits. In addition, it is desired to reduce the amount of energy normally lost in charging and discharging the capacitance of the plasma panel.

It is therefore desired to reduce the cost of plasma panel reduction by reducing the cost by the associated electronics.

It is also desired to reduce the operational cost of plasma panels.

SUMMARY OF THE INVENTION

In accordance with one aspect of the present invention, an improved address driver circuit is provided for the ISA plasma panel. The new driver circuit utilizes open-drain (N-channel or P-channel) MOSFET output structure which can be made at a lower cost compared to the normally used totem-pole drivers. A unique feature of the present invention resides in a technique used to apply the proper positive and negative pulses to the ISA plasma display panel by using identical, low cost N-channel open-drain MOSFET devices. Thus, in contrast with prior plasma panel address driver circuits that must be able to pull high (i.e., drive the plasma panel with a positive pulse) and pull low (i.e., drive the plasma panel with a negative pulse) the unique feature of the present invention enables the N-channel open-drain MOSFET devices only to be designed to pull low.

In accordance with another aspect of the present invention, a power efficient sustainer circuit has been developed for use with flat panels having substantial inherent panel capacitance due to the panel electrodes, such as plasma display panels, electroluminescent panels, liquid crystal displays, etc. The new sustain driver circuit uses inductors in charging and discharging the panel capacitance so as to recover 90% of the energy normally lost in driving the panel capacitance. Accordingly, a plasma panel incorporating a power efficient sustain driver circuit according to the present invention can operate with only 10% of the energy normally required with prior art plasma panel sustaining circuits.

BRIEF DESCRIPTION OF THE DRAWINGS

FIG. 8 are waveform diagrams useful in understanding the operation of FIGS. 7 and 9;

FIG. 9 and 9*a* are schematic circuit diagrams showing a constructed embodiment of a new sustain driver according to the invention;

DETAILED DESCRIPTION OF THE DRAWINGS

The present invention will be described in connection with an ISA plasma panel to which has been incorporated a new and improved address driver circuit in accordance with one aspect of this invention, and a new power efficient sustain driver circuit in accordance with another aspect of the present invention. For convenience of description, the first aspect of this invention, i.e., the new and improved address driver circuit will be described followed by the description of the power efficient sustain driver circuit.

ISA Driver Circuits For Plasma Panels

Figure 1:
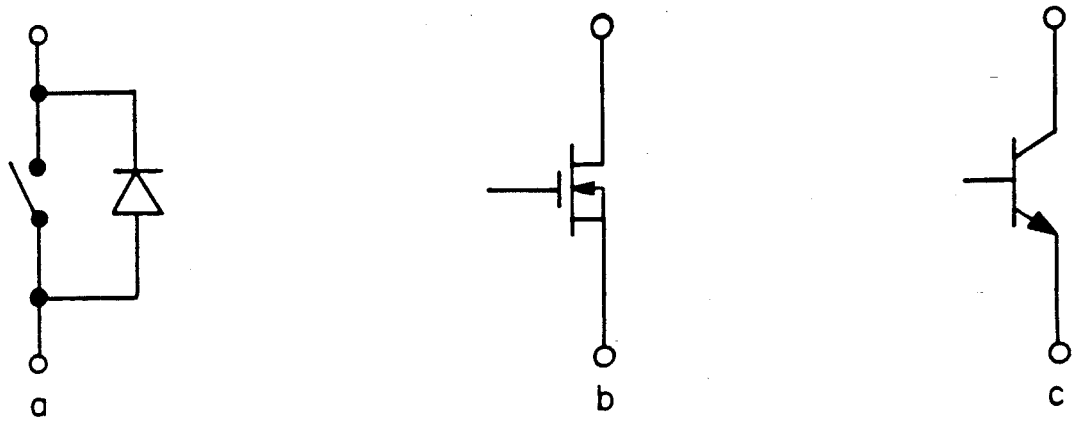
FIGS. 1*a*, 1*b*, 1*c* are schematic representations of switch devices useful in explaining an address circuit driver.

A major advance of this invention is the simplification of the address circuit drivers. These drivers only need to be designed to pull low. This contrasts with the normal plasma panel circuits that must be able to pull high and pull low. The pull low type driver can be fabricated at considerably lower cost. FIG. 1 shows the basic type of address circuit driver that can be used in this invention. FIG. 1*a* shows a simple switch in parallel with a diode. The switch is used to apply selective address pulses to the plasma panel depending on the state (open or closed) of the switch. With today's solid state switching technology, this switch usually takes two forms: the MOS Field Effect Transistor (MOSFET), shown in FIG. 1*b* and the Bipolar transistor shown in FIG. 1*c*. Usually there is an inherent parallel diode associated with these transistors so that the diode in parallel with the switch in FIG. 1*a* should be understood as being included in the circuit model. The examples presented here are for N-channel MOSFETs and npn Bipolar transistors because these are usually the best devices for integration. However, devices of the opposite polarity could be used with the appropriate adjustment in the waveforms and circuits.

Figure 2:
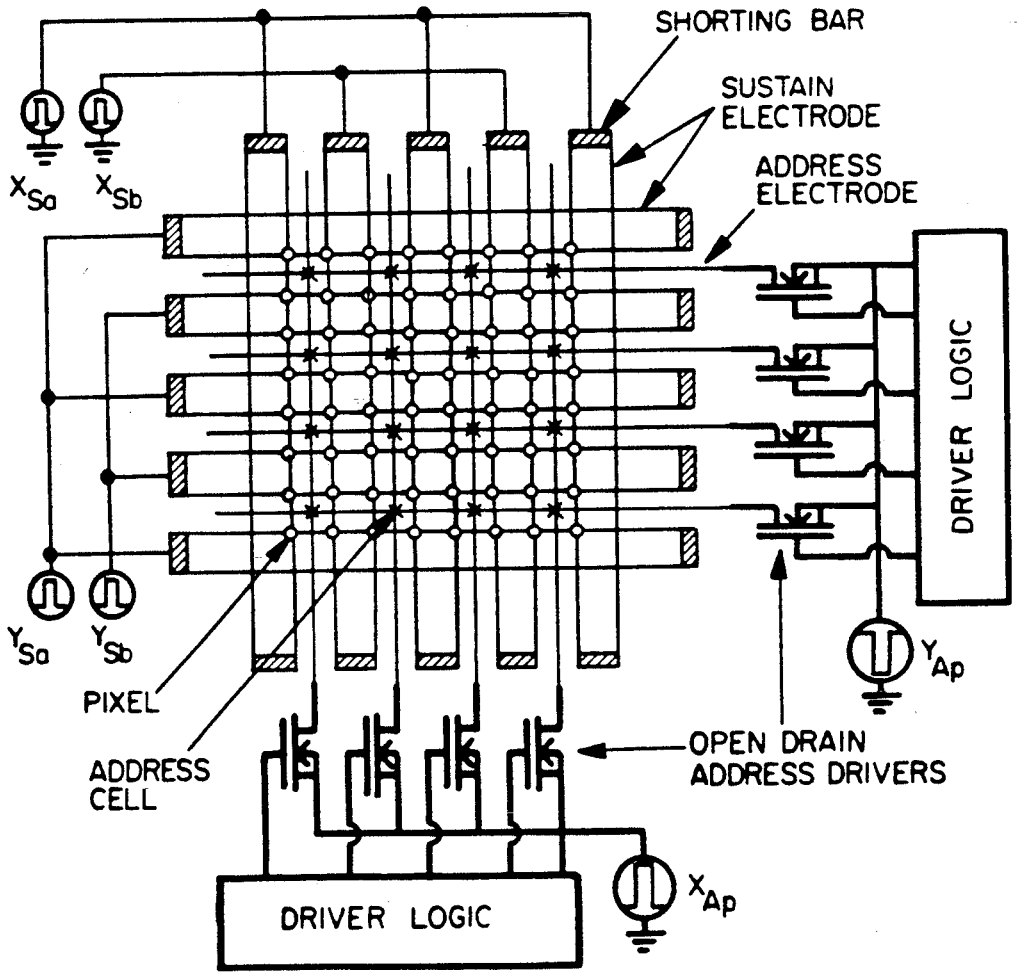
FIG. 2 is a plan view of a plasma panel with open-drain address drivers and sustain drivers in accordance with one aspect of the invention.

FIG. 2 shows a circuit diagram for applying the concepts of this invention to drive the address electrodes in an ISA plasma panel i.e., a plasma display panel having independent sustain and address electrodes as previously described.

This example uses the N-channel MOSFET devices shown in FIG. 1*b*, but of course other suitable switches could be used. The basic concept is to connect the drain electrode of each MOSFET to each address electrode of the ISA plasma panel and to then connect all of the sources of the MOSFETs on a given display axis to a common bus. When such MOSFET transistors are integrated, it is very easy to fabricate arrays of these transistors when they have all of the sources connected to a common bus. This arrangement is commonly referred to as the open drain configuration. Note that both the X axis and Y the axis address electrodes in FIG. 2 use N-channel MOSFETs in the open drain configuration. This has the advantage that the same electrical parts can be used for both the X and the Y axis. This allows lowering of circuit costs because normally two distinct parts must be designed, fabricated and stocked. In addition, a single part will be made at twice the volume of that of the systems that require two parts and therefore the higher volume of the single part will result in lower costs. Two parts are normally required because the X and Y axes require different polarity address pulses. In the example shown here, the X axis requires a positive pulse and the Y axis requires negative pulses. A novel feature of this invention is the technique used to apply the proper positive and negative pulses to the ISA plasma display panel address electrodes by using identical low cost N-channel open drain MOSFET devices.

Figure 3:
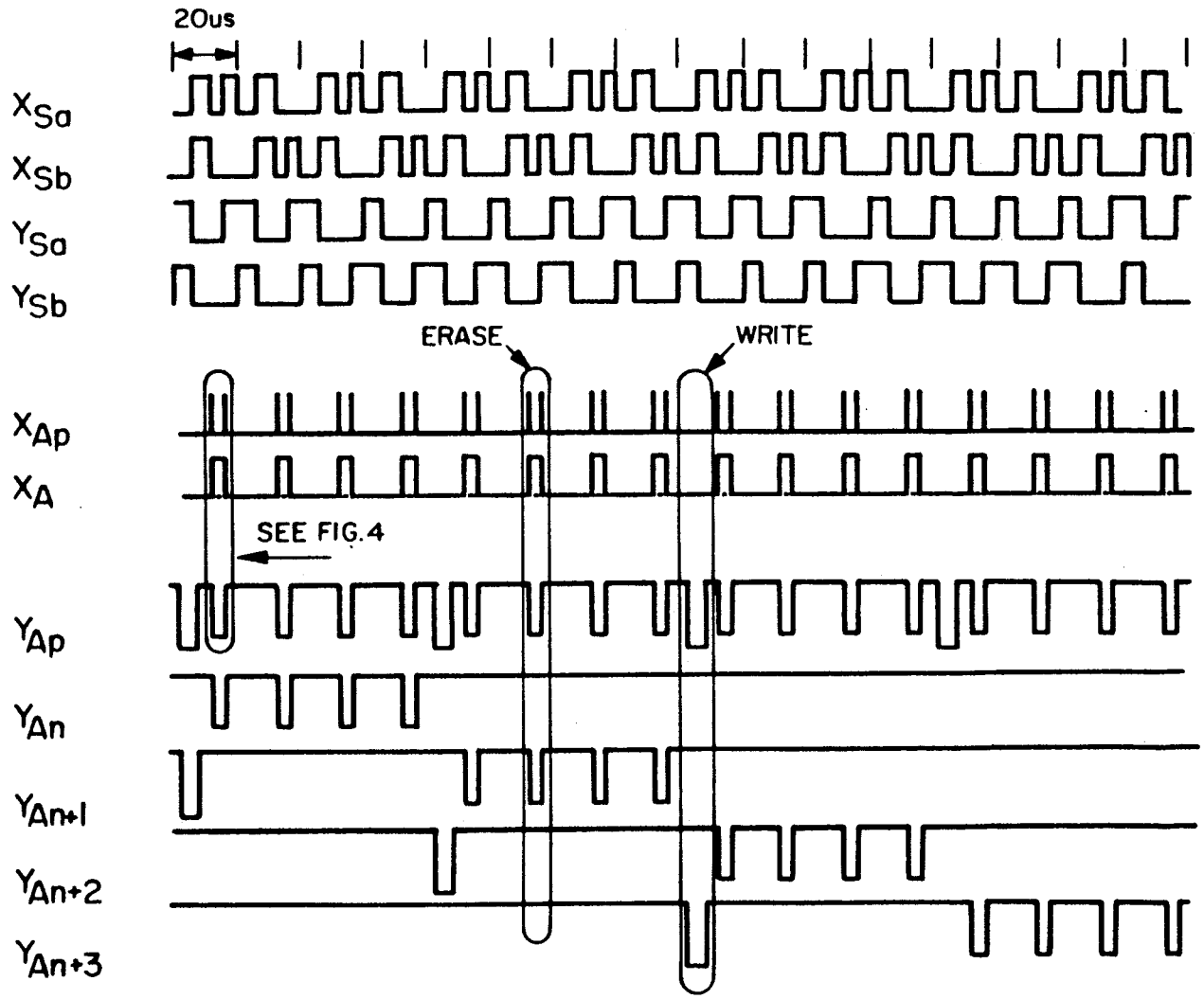
FIG. 3 are waveform diagrams useful in understanding the operation of FIG. 2.

FIG. 3 shows the waveforms used to drive the ISA panel. This shows a portion of the video scan of the panel for addressing the eight rows of pixels shown in FIG. 2 in a top to bottom sequence. Other scanning techniques may be used rather than the video scan example illustrated here. Each row of pixels requires two of the 20 microseconds addressing cycles. The top four waveforms show the signals applied by the four sustainers. The phasing of these waveforms selects which of the four pixels surrounding each address cell in FIG. 2 can be addressed during a given addressing cycle. The fundamental periodicity of this phasing is every eight addressing cycles because of the sustain electrode connection technique used in FIG. 2.

Below the sustain waveforms are the signals associated with the address electrodes. The waveforms labeled XAP and YAP are supplied from address pulse generators that are connected to the common bus of the address driver transistors as shown in FIG. 2. These address pulsers generate the special waveforms needed for the address drivers to apply the proper signals to the address electrodes. The XA waveform shows the selective erase signals on the X address electrodes. A high XA level will erase a selected pixel and a low level leaves the pixel on. The YA waveforms for four adjacent Y address electrodes are shown at the bottom of FIG. 3.

Y Axis Operation

We will now investigate the details of how the FIG. 2 circuit operates. The Y axis will be examined first since its operation is the simplest. The linear array of open drain transistors have all of their source electrodes connected to a common bus. This bus is connected to a pulse generator called the Y address pulser and labeled YAP. The purpose of this generator is to supply the energy for the address pulses and to determine the shape of the waveforms applied to the selected Y address electrodes. Notice that, as shown in FIG. 3, this generator supplies double amplitude negative pulses. For instance, during the address period, a negative pulse needs to be applied to the selected Y address electrodes. During this period, a negative pulse is generated by YAP and this pulse is applied to the source electrode of all of the Y address transistors. Any transistors that are off do not conduct and their associated plasma panel address electrodes remain at virtually the same potential as they were before the generation of the negative pulse. Any transistors that are turned on will conduct and their associated plasma panel address electrodes will be pulsed negative to cause an address operation in the plasma panel. Any number of Y address electrodes could be selectively pulsed negative with this technique, however, in video mode, the Y axis address electrodes are usually pulsed one at a time in a sequential manner that causes the image to be scanned.

Since the address electrodes of an ISA plasma panel can be reasonably modeled as a simple capacitance, the current through the transistors flows predominently during the transitions of the YAP generator. During the negative transition of the YAP generator the conduction current must flow predominantly through the transistor. However, during the positive going transition of the negative address pulse (as it returns to the initial level before the application of the negative pulse), the current can flow through both the MOSFET transistor and also through the body diode that is associated with the transistor. This body diode will of course conduct whether the transistor is in the on or off states. This will allow all of the Y address electrodes to be pulled to the same high level when the YAP generator is at its high level.

X Axis Operation

We will now discuss the operation of the X axis circuits shown in FIG. 2. This circuit differs from that of the Y axis because the X axis must be capable of applying a positive pulse as opposed to the negative pulse of the Y axis. Note that just like for the Y axis, the array of N-channel open drain MOSFET transistors has all source electrodes connected to a common bus and this bus is connected to the X address pulse generator labeled as XAP. This XAP generator operates quite differently from the YAP generator because of the opposite polarity of the output pulse. The shape of the XAP waveform is two short pulses (see FIG. 3 and the expanded view of FIG. 4) used to generate a single longer pulse on the plasma panel address electrodes. The first XAP pulse corresponds to the leading edge of the address electrode pulse and the second XAP pulse corresponds to the trailing edge of the address electrode pulse.

Now we examine the first XAP pulse. It is assumed that all of the address electrodes are initially at the same potential as the XAP generator just before the application of the first pulse. As the XAP generator rises, current flows through all of the body diodes of the MOSFET transistors. This pulls up all of the X address electrodes to a level that is just one diode drop lower than the XAP generator. This action continues until the XAP generator reaches its first peak. Note that all X address electrodes ar pulsed positive at this time regardless of whether they are selected or not.

The selection operation does not occur until the falling edge of the first XAP pulse. During this time, if a positive pulse is to remain on any selected X address electrodes, then the associated MOSFET transistor is turned off. The transistors that are left on will pull their address electrodes down as the first pulse of the XAP generator falls. This action continues until the XAP generator stops falling at the end of the first pulse. At this time, all of the selected address electrodes are at a high voltage level and the unselected address electrodes are at a low level. This situation can continue for a long period until the second XAP pulse. The selected address electrodes are held high by the capacitance of the plasma panel address electrodes to the sustain electrodes. The unselected address electrodes are held at the low voltage of the XAP generator by the MOSFET transistors that are turned on.

The selection pulse can be terminated by turning all of the transistors on while the XAP generator is at the low level. This works but with some undesirable characteristics. First of all, when the selected transistors are turned on, they quickly discharge the voltage of the address electrode. The discharge rate is frequently so fast that a large amount of displacement current flows through the transistors and the plasma panel capacitance. This displacement current can cause a number of problems. First, this current frequently grows and decays at a very fast rate so that large amounts of electrical noise is generated. This noise tends to create problems for other circuits in the system and can easily mistrigger many of the logic gates that ar used to control th operations of the plasma panel. A second problem of this large current is the large energy dissipation that occurs in the transistor to discharge the capacitance. This energy dissipation can be enough to burn out the transistors in some cases. It also makes the transistors hot and requires special heat sinking requirements. In addition, the energy lost in heating these transistors cannot be recovered and it increases the power requirements of the power supply and the power consumption of the plasma display system.

All of these problems can be significantly reduced with the following switching technique. Shortly before the X address pulse needs to fall, the XAP generator begins the rise of its second pulse. Recall that the first XAP pulse was used to initiate the address pulse. During the rise of the second pulse, current flows through the body diodes of the MOSFETs associated with the unselected X address electrodes. If the MOSFETs of the unselected transistors are still on, there will also be some conduction through these MOSFETs. This current charges up the unselected address electrodes and causes their voltage to rise. This charging continues until the second X pulse reaches its peak. At this peak, all of the X axis MOSFETs should be turned on. As the second XAP pulse begins to fall, a current flows through all of the X MOSFETs which discharges all of the address electrodes. This action continues until the second X pulse completes its fall to its lowest level. At this point, all of the address electrodes should be at this low XAP voltage. This is the final stage of the addressing operation and all of the X address electrodes will be held at this low voltage level until the next addressing operation.

The write before erase addressing proceeds with the following sequence. FIG. 3 shows that a write pulse is first applied to the YAn+1 electrode which turns on all of the pixels in the two rows on either side of YAn+1.

After the completion of this write pulse, four erase pulses are used to selectively erase the pixels in the two rows on either side of YAn. The image is introduced in the panel through a selective erase by controlling the voltage of the XA address electrodes during the erase operation. The sequence continues by writing the two rows on either side of YAn+2 and then selectively erasing the two rows next to YAn+1. This staggering of the write and erase operation improves panel voltage margins by allowing the written cells to stabilize for at least four cycles before the selective erase operation occurs. Note that the addition of the write operation to the addressing sequence does not require any additional time beyond that already needed for the sustain and selective erase operations. This allows higher update rates.

A key factor that allows the use of low-cost open-drain address drivers is the design of the address pulser waveforms. FIG. 3 shows that the YA address electrodes require selectively applied negative pulses and the XA address electrodes require selectively applied positive pulses. The design of the X and Y address pulser waveforms allows these two polarities with the same N-channel IC design.

In summary of the YA operation first, note that the YAP signal applied to the sources of all of the Y address transistors closely follows the selected YA address electrodes signals. At a given time a selected YA electrode transistor is turned on and all of the other YA transistors are kept off. Thus the negative pulse generated by YAP is transferred to the selected YA address electrode.

A summary of the operation of the XA address electrodes is more complicated. This is shown in the FIG. 4 expanded view of the FIG. 3 waveforms. Note that the XAP waveform shows two short pulses for each XA erase pulse. These pulses define the leading and trailing edges of the XA erase pulse. They have a sine wave shape since in a constructed embodiment of the invention they are generated with an energy recovery circuit similar to the sustain drive circuit described hereinafter. The rise of the first XAP pulse pulls all of the XA address electrodes high through the body diode and conduction channel of the MOSFET address drivers. At the peak of the first XAP pulse the selected MOSFETs are turned off if the selected pixel is to be erased. The MOSFETs that are left conducting will pull their XA address electrodes low as the first XAP pulse falls low. The selected MOSFETs that are not conducting will remain high by means of the capacitance of the address electrode to the sustain electrodes. This high level on the address electrode causes erasure of the pixel.

The rise of the second XAP pulse pulls all of the non-selected XA address electrodes to the same high level as the selected XA address electrodes. At the peak of the second XAP pulse, all of the X axis address drivers are turned on so that the fall of the second XAP pulse will pull all of the address electrodes to the initial low level.

Figure 4:
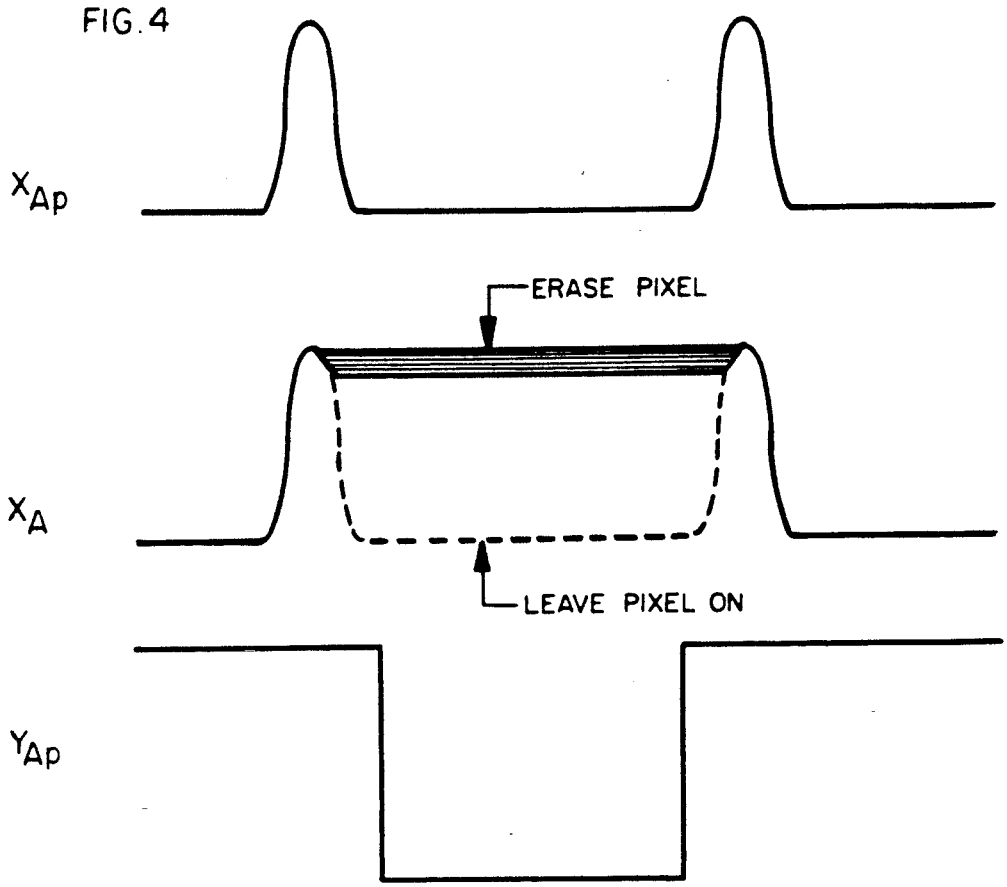
FIG. 4 are waveform diagrams showing an expanded view of the section of FIG. 3 labeled 4—4.

The above XA address technique successfully places positive pulses on the selected XA address electrodes, however, it is also places two short positive pulses on the non-selected XA address electrodes that correspond to the pulse of XAP. To prevent these two short pulses from causing mis-addressing of the non-selected pixels, the YAP pulse is properly phased as shown in FIG. 4. The YAP pulse falls after the fall of the first XAP pulse and YAP rises before the rise of the second XAP pulse. This prevents the non-selected XA pulses from adding to the selected YA pulse to cause a mis-addressing discharge.

One concern is that when the column drivers are in a high impedance state, the pulses applied to a neighboring electrode in the low impedance state will capacitively couple to the high impedance electrode and cause it to receive the wrong voltage amplitude. This is not a significant problem for two reasons. First, note that in FIG. 2, the address electrodes are shielded from each other by the sustain electrodes. This makes the variations in pulse amplitude, due to address line-to-line coupling, less than 10% of the address pulse amplitude as shown in FIG. 4. The second point is that this 10% variation is not a significant problem because of the excellent address margins of the ISA design.

Standard voltage pulse generators can be used as the XAP and YAP address pulse generators supplying th corresponding waveforms of FIG. 3. Alternatively, the energy recovery technique described hereinafter with respect to the power efficient sustain driver circuit ca be used for the XAP and YAP address pulse generators.

Power Efficient Sustain Drive Circuit

The plasma panel requires a high voltage driver circuit called a sustainer, or sustain driver circuit, which drives all the pixels and dissipates considerable power. As an example, four sustainer drivers XSA, XSB, YSA, YSB are shown in FIG. 2 with the ISA panel.

The following describes a new high-efficiency sustainer that eliminates most of the power dissipation resulting from driving the plasma panel with a conventional sustainer. With this new sustainer, considerable savings can be realized in the overall cost of the plasma panel. The new sustainer can be applied to standard plasma panels, or the new ISA plasma panel, as well as to other types of display panels requiring a high voltage driver, such as electroluminescent or liquid crystal panels having inherent panel capacitance.

When the plasma panel is used as a display, frequent discharges are made to occur by alternatively charging each side of the panel to a critical voltage, which causes repeated gas discharges to occur. This alternating voltage is called the sustain voltage. If a pixel has been driven "ON" by an address driver, the sustainer will maintain the "ON" state of that pixel by repeatedly discharging that pixel cell. If a pixel has been driven "OFF" by an address driver, the voltage across the cell is never high enough to cause a discharge, and the cell remains "OFF".

The sustainer must drive all of the pixels at once; consequently, the capacitance as seen by the sustainer is typically very large. In a 512×512 panel, the total capacitance of all the pixel cells in the panel, Cp, could be as much as 5 nF.

Conventional sustainers drive the panel directly, and thus $\frac{1}{2}CpV_s^2$ is dissipated in the sustainer when the panel is subsequently discharged to ground. In a complete sustain cycle, each side of the panel is charged to $V_s$ and subsequently discharged to ground. Therefore, a total of $2CpV_s^2$ is dissipated in a complete sustain cycle. The power dissipation in the sustainer is then $2CpV_s^2f$, where f is the sustain cycle frequency. For Cp=5nF, $V_s$=100V, and f=50 kHz, the power dissipation in the sustainer, resulting from driving the capacitance of the panel, is 5 W.

If an inductor is placed in series with the panel, then Cp can be charged and discharged through the inductor. Ideally, this would result in zero power dissipation since the inductor would store all of the energy otherwise lost in the output resistance of the sustainer and transfer it to or from Cp. However, switching devices are needed to control the flow of energy to and from the inductor, as Cp is charged and discharged. The "ON" resistance, output capacitance, and switching transition time are characteristics of these switching devices that can result in significant energy loss. The amount of energy that is actually lost due to these characteristics, and hence the efficiency, is determined largely by how well the circuit is designed to minimize these losses.

In addition to charging and discharging Cp, the sustainer must also supply the large gas discharge current for the plasma panel. This current, I, is proportional to the number of pixels that are "ON". The resulting instantaneous power dissipation is $I_2R$, where R is the output resistance of the sustainer. Thus, the power dissipation due to the discharge current is proportional to $I_2$, or the square of the number of pixels that are "ON".

There are two ways to minimize this dissipation. One is to minimize the output resistance of the sustainer by using very low resistance output drivers, and the other is to minimize the number of pixels that are "ON" at any time.

This invention provides a new sustainer circuit that will recover the energy otherwise lost in charging and discharging the panel capacitance, Cp. The efficiency with which the sustainer recovers this energy is here defined the "recovery" efficiency. When Cp is charged to $V_s$ and then discharged to zero, the energy that flows into and out of Cp is $CpV_s^2$; therefore, the recovery efficiency is defined by $$Eff = 100 \times (CpV_s^2 - E_{lost})/CpV_s^2 = 100 \times (1 - (E_{lost}/CpV_s^2)) \text{ percent}$$

where $E_{lost}$ is the energy lost in charging and discharging Cp.

Notice that the recover efficiency is not the same as the conventional power efficiency, defined in terms of the power delivered to a load, since no power is delivered to the capacitor, Cp; it is simply charged and then discharged. The recovery efficiency is a measure of the energy loss in the sustainer.

A circuit proposed for driving electroluminescent (EL) panels, published in M. L. Higgins, "A Low-power Drive Scheme for AC TFEL Displays", *SID International Symposium Digest of Technical Papers*, Vol. 16, pp. 226–228, 1985, was tested in the laboratory, but was abandoned since it was not capable of better than 80% energy recovery, and it has undesirable design complexities. A new, very efficient sustain driver was then developed which eliminates the problems inherent in the prior proposed circuit.

First, a circuit model of the new sustain driver circuit will be analyzed to determine the expected recovery efficiency. The reasons why greater than 90% recover efficiency is possible with this new sustain driver will be explained, and several design guidelines will be given. Next, a constructed prototype of the new sustain driver will be discussed.

Figure 5:
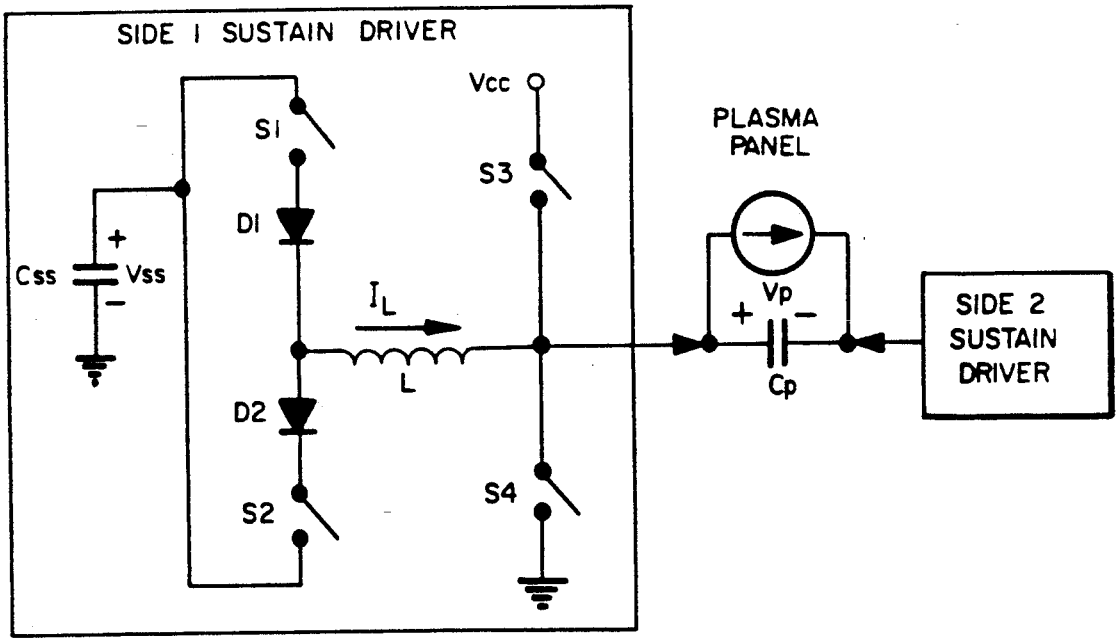
FIG. 5 is a schematic circuit diagram showing an ideal model of a new sustain driver according to the invention.
Figure 6:
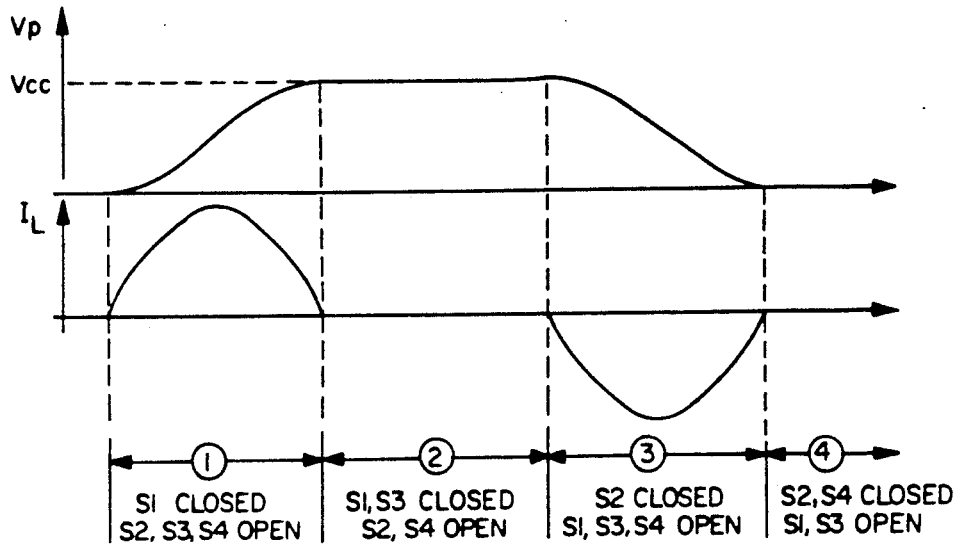
FIG. 6 are waveform diagrams useful in understanding the operation of FIG. 5.

An ideal sustain driver circuit will be presented first to show the basic operation of the new sustain driver, given ideal components. As would be expected, given ideal components, this circuit has 100% recovery efficiency in charging and discharging a capacitive load. The schematic of the ideal sustain driver circuit is shown in FIG. 5, and in FIG. 6 are shown the output voltage and inductor current waveform expected for this circuit as the four switches are opened and closed through the four switching states. The operation during these four switching states is explained in detail below, where it is assumed that prior to State 1, Vss is at Vcc/2 (where Vcc is the sustain power supply voltage), Vp is at zero, S1 and S3 are open, and S2 and S4 are closed. The reason that $V_s$s is at Vcc/2 will be explained, below, after the switching operation is explained:

State 1. To start, S1 closes, S2 opens, and S4 opens. With S1 closed, L and Cp form a series resonant circuit, which has a forcing voltage of Vss=Vcc/2. Vp then rises to Vcc, at which point $I_L$ is zero, and D1 becomes reverse biased. Alternatively, diode D1 could be eliminated and S1 opened when Vp rises to Vcc (at the point where $I_L$ is zero).

State 2. S3 is closed to clamp Vp at Vcc and to provide a discharge current path for any "ON" pixels.

State 3. S2 closes, S1 opens, and S3 opens. With S2 closed L and Cp again form a series resonant circuit, which has a forcing voltage of Vss=Vcc/2. Vp then falls to ground, at which point $I_L$ is zero, and D2 becomes reverse biased. Alternatively, diode D2 could be eliminated and S2 opened when Vp falls to zero (at the point where $I_L$ is zero).

State 4. S4 is closed to clamp Vp at ground while an identical driver on the opposite side of the panel drives the opposite side to Vcc and a discharge current then flows in S4 if any pixels are "ON".

It was assumed above that Vss remained stable at Vcc/2 during the above charging and discharging of Cp. The reasons for this can be seen as follows. If Vss were less than Vcc/2, then on the rise of Vp, when S1 is closed, the forcing voltage would be less than Vcc/2. Subsequently, on the fall of Vp, when S2 is closed, the forcing voltage would be greater than Vcc/2. Therefore, on average, current would flow into Css. Conversely, if Vss were greater than Vcc/2, then on average, current would flow out of Css. Thus, the stable voltage at which the net current into Css is zero is Vcc/2. In fact, on power up, as Vcc rises, if the driver is continuously switched through the four states explained above, then Vss will rise with Vcc at Vcc/2.

If this were not the case, a regulated power supply would be needed to supply the voltage Vss. This would increase the overall cost of the sustain circuitry and could make this design less desirable.

Figure 7:
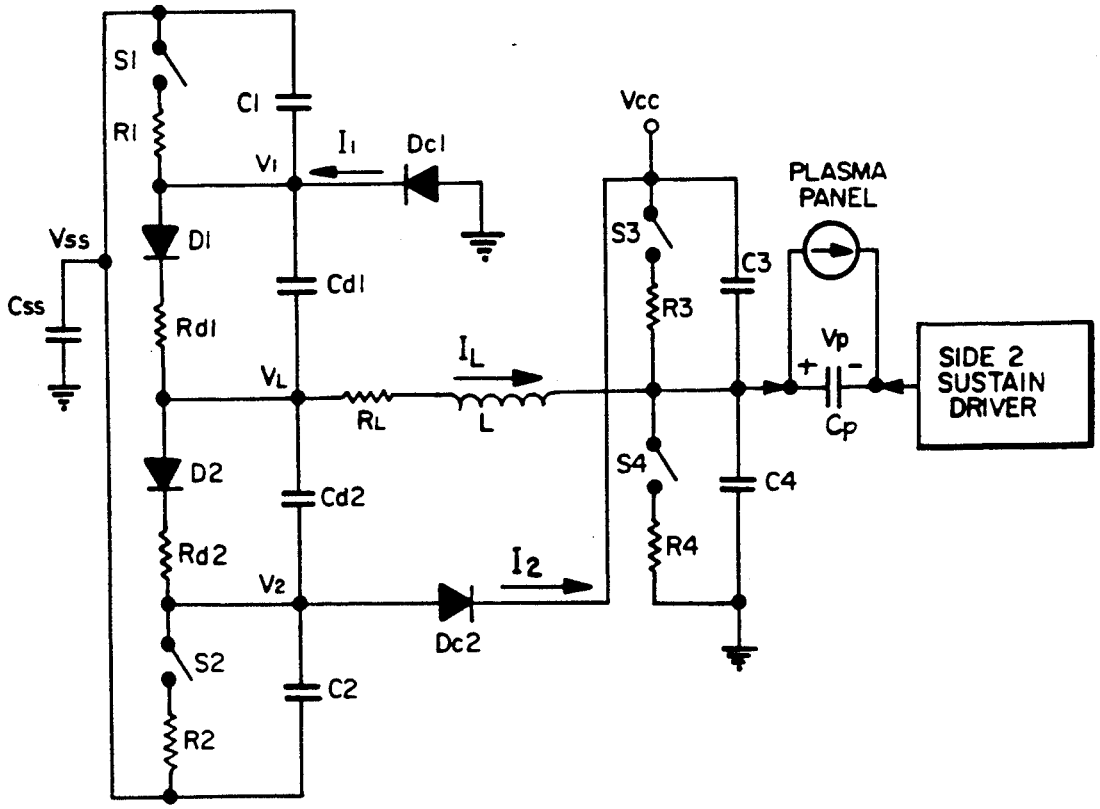
FIG. 7 is a schematic circuit diagram showing a practical circuit model of a new sustain driver according to the invention.

The energy losses due to the capacitances and resistances inherent in the real devices, i.e., the switching devices, the diodes, and the inductor, can be determined by analysis of a practical circuit model shown in FIG. 7. The switching devices are modeled by an ideal switch, an output capacitor, and a series "ON" resistor. The diodes (except Dc1 and Dc2) are modeled by an ideal diode, a parallel capacitor, and a series resistor, and the inductor is modeled by an ideal inductor and a series resistor.

Dc1 and Dc2 are ideal diodes. They are included to prevent V1 from dropping below ground and V2 from rising above Vcc. As will be shown below, if Dc1 and Dc2 were not included, then the voltages across C1, Cd2, C2, and Cd2 would be higher than otherwise, which would lead to additional energy losses.

The switching sequence of this circuit is the same as that of the ideal model shown in FIG. 5. FIG. 8 shows the voltage levels for Vp, V1, VL, and V2 and the current levels for $I_L$, I1, and I2 during the four switching states. Again, it is assumed that Vss is stable at Vcc/2.

The recovery efficiency in the practical circuit model of FIG. 7 can be determined below with reference to FIG. 8. For example, the energy losses due to the capacitance of the switching devices (C1 and C2) and the diodes (Cd1 and Cd2) can be determined; then, the energy losses due to the resistances of the switching devices (R1 and R2), the diodes (Rd1 and Rd2), and the inductor ($R_L$) can be determined; and finally, the energy loss due to the finite switching time of the switching devices can be determined. In each case, reference ca be made to the four switching states, shown in FIG. 8.

To find the power dissipation resulting from the capacitances of the switching devices and the diodes, an account is made of all the $\frac{1}{2}CV^2$ loss. It is assumed that, initially, S1 and S3 are open, S2 and S4 are closed, $V_L$ is at ground, and Vss is at Vcc/2.

State 1. To start, S1 closes and S4 opens. V1 and $V_L$ then rise to Vss, and the voltages across Cd2 ($V2-V_L$) and across C1 (Vss−V1) both fall from Vss to zero. Thus, $C1Vss^2/2$ is dissipated in R1 and $Cd2Vss^2/2$ is dissipated in R1, Rd1, and R2. S2 then opens. With S1 closed, the series combination of R1, Rd1, L, and Cp is a series RLC circuit with a forcing voltage of Vss=Vcc/2. The waveforms are shown in FIG. 8. As $I_L$ falls to and crosses zero, then D1 becomes cut off and $V_L$ begins to rise.

State 2. S3 is closed to clamp Vp at Vcc. (Notice that before S3 closes Vp has not completely risen to Vcc, due to the damping that was caused by R1, Rd1, and RL. Thus, when S3 is closed, Vp is pulled p to Vcc through S3, and a small amount of overshoot cold occur if there were stray inductances present in the real circuit. This overshoot is shown in the waveform for Vp in FIG. 8). $I_L$ then becomes negative as C2 and Cd1 ($V_L-V1$) both rise from zero to Vss, at which point Dc2 becomes forward biased and I2 begins to flow. The energy in the inductor, when I2 begins to flow, is then $\frac{1}{2}(C2+Cd1)Vss^2$. This energy is dissipated in $R_L$, Rd2, and R3 as I2 falls to zero.

State 3. After the discharge current for any "ON" pixel cells has been supplied, then S2 closes and S3 opens. V2 and $V_L$ then fall to Vss, and the voltages across Cd1 ($V_L-V1$) and across C2 (V2−Vss) both fall from Vss to zero. Thus, $C2Vss^2/2$ is dissipated in R2 and $Cd1Vss^2/2$ is dissipated in R2, Rd2, and R1. S1 then opens. With S2 closed, the series combination of R2, Rd2, RL, L, and Cp is a series RLC circuit with a forcing voltage of Vss=Vcc/2. The waveforms are shown in FIG. 8. As $I_L$ rises to and crosses zero, then D2 becomes cutoff and VL begins to fall.

State 4. S4 is closed to clamp Vp at ground. (Notice that before S4 closes, Vp has not completely fallen to ground, due to the damping that was caused by R2, Rd2, and $R_L$. Thus, when S4 is closed, Vp is pulled down to ground through S4, and a small amount of undershoot could occur if there were stray inductances present in the real circuit. This undershoot is shown in the waveform for Vp in FIG. 8.) $I_L$ then becomes positive as CC1 and Cd2 are charged from the inductor. The voltages across C1 (Vss−V1) and across Cd2 (V2−VL) both rise from zero to Vss, at which point Dc1 becomes forward biased and I1 begins to flow. The energy in the inductor when I1 begins to flow is then $\frac{1}{2}(C1+Cd2)Vss^2$. This energy is dissipated in $R_L$, Rd1, and R4 as I1 falls to zero.

Thus, it can be determined that the practical circuit model of FIG. 7 results in a power loss of $(f)E_{lost}=0.17$ W, where the sustain frequency is equal to f =50 kHz. By comparison, if there were no energy recovery, then the normal loss from charging and discharging Cp would be $(f)CpVcc^2=2.5$ W. The recovery efficiency (as previously defined) of the circuit of FIG. 7 is $$Eff=100\times(1-(E_{lost}/CpVcc^2))=93\%$$

where Cp=5 nF and Vcc=100 V.

In summary, the practical circuit model of FIG. 7 predicts the the new sustain driver will be capable of 93% recovery, assuming that the Q of the inductor is at least 80 and that the optimum tradeoff between switch output capacitance and "ON" resistance is realized.

The schematic of a constructed prototype sustain driver circuit is shown in FIG. 9, and a complete parts list is given in Table 1.

It was found that the waveforms of the constructed circuit of FIG. 9 correspond almost exactly with the waveforms of FIG. predicted from the circuit model of FIG. 7.

Switches S1, S2, S3, and S4 in FIG. 7 were previously described as being switched at the appropriate times to control the flow of current to and from Cp. In the prototype circuit of FIG. 9, the power MOSFETs (T1, T2, T3, T4) replace the ideal switches of FIG. 7 and must be switched at the appropriate times by real drivers to control the flow of current to and from Cp. Switching T1 and T2 at the appropriate times requires only that they are switched on the transition of Vi. Thus, only a single driver (Driver 1) is required. Switching T3 and T4 presents a more difficult problem, however, since in addition to being switched on the transition of Vi, they must also be switched whenever the inductor current crosses zero. This could have required that T3 and T4 be controlled with additional inputs to the FIG. 9 circuit if it were not the case that V1 and V2 make voltage transitions whenever Vi makes a transition and shortly after the inductor current crosses zero. Thus, the switching of T3 and T4 is accomplished by using the transitions of V1 and V2 to switch the Drivers (2 and 3) in FIG. 9 at the appropriate times and no additional inputs are required.

Switching the MOSFETs can be seen with reference to FIG. 9 and the following description. When Vi rises, the output of Driver 1 is switched "LOW" and the gates of T1 and T2 are driven "LOW" through the coupling capacitors, $C_{g1}$ and $C_{g2}$. Thus, T1 is switched "ON", T2 is switched "OFF", and current begins to flow in the inductor to charge Cp. Also, D3 becomes forward biased and D4 is reverse biased. This causes Driver 2 to quickly switch "LOW", thus driving T4 "OFF", while Driver 3 is delayed from switching "LOW" until after Vp has risen. (As will be explained later, R1 and R2 are needed only during initial startup when Vcc power is first applied and before Vss has risen high enough for Drivers 2 and 3 to be switched from the changes in voltage of V1 and V2.)

Referring back to the end of State 1 in FIG. 8 it can be seen that V2, in FIG. 9 will begin to rise from Vss to Vcc shortly after the inductor current into Cp has fallen to zero, at which time, T3 must be switched "ON" to clamp Vp at Vcc. In FIG. 9, when V2 rises, then the input of Driver 3 also rises, due to the current through the coupling capacitor C4. The output of Driver 3 then switches "LOW", and the gate of T3 is driven "LOW"

throughout he coupling capacitor, $C_{g3}$. Thus, T3 is switched "ON" and clamps Vp to Vcc.

Later, when Vi falls, the output of Driver 1 is switched "HIGH" and the gates of T1 and T2 are driven "HIGH" through the capacitors, $C_{g1}$ and $C_{g2}$. Thus, T1 is switched "OFF", T2 is switched "ON", and current begins to flow in the inductor to discharge Cp. Also, D4 becomes forward biased and D3 becomes reverse biased. This causes Driver 3 to quickly switch "HIGH", thus driving T3 "OFF", while Driver 2 is delayed from switching "HIGH" until after $V_p$ has fallen.

When V1 begins to fall from Vss to ground, shortly after the inductor current flowing out of Cp has fallen to Zero (as at the end of State 3 in FIG. 8), then the input of Driver 2 falls because of the coupling capacitor C3. The output of Driver 2 then switches "HIGH", and the gate of T4 is driven "HIGH". Thus, T4 is switched "ON" and clamps Vp to ground.

Notice that an external timing circuit is not needed to determine when to switch T3 and T4 because the switching occurs shortly after the inductor current crosses zero, independent of the rise or fall time of Vp. This leads to simple circuitry that is independent of variations in the inductance (L) or the panel capacitance (cp) and is a significant advantage over prior proposed sustain drivers. It also makes it possible to drive the circuit with only one input, so that if the input becomes stuck ("HIGH" or "LOW"), T3 and T4 cannot both be "ON" simultaneously, which would result in the destruction of one or both of the devices.

Another advantage that this circuit has over prior proposed circuits is that T1, D1, T2 and D2 need only be ½ Vcc rather than the full Vcc voltage of prior circuits. Lower voltage switching devices, requiring lower breakdown voltages, are typically less costly to fabricate. This results in a lower parts cost for a discrete sustainer and lower integration costs for an integrated sustainer.

The resistors, R1 and R2 are provided for the case in which Vss is at a very low voltage, such as during initial power up of Vcc. In this case, the voltages V1 and V2 do not change enough to cause the Drivers 2 and 3 to switch. The resistors will cause the Drivers 2 and 3 to switch, after a delay time, which is determined by the value of the resistors and the input capacitance of the Drivers.

The reason it is necessary to switch the Drivers 2 and 3 during initial power up when Vss is very low is as follows. In order for Vss to rise, it is first necessary to T3 to switch "ON" and bring Vp up to Vcc. Then, when T2 turns "ON", a current will flow from Cp to Css. If T4 is later switched "ON", thus clamping Vp to ground, then when T1 turns "ON", the current that flows out of Css will prevent Vss from rising above Vcc/2, and Vss will begin to stabilize at Vcc/2 after several cycles of charging and discharging Cp. Thus Vss will not achieve the proper voltage unless T3 and T4 are switched "ON" by the action of R1 and R2 during power up.

The resistor, R3, is provided to discharge the source to gate capacitance of T3 when the supply voltage, Vcc, suddenly rises during power up. Without R3, the source to gate voltage of T3 would rise above threshold, as Vcc rises, and remain there, with T3 "ON", after Vcc has risen. Then, if T4 were switched "ON", a substantial current would flow through T3 and t4 and possibly destroy one or both of the devices.

TABLE 1

| Part Name | Number | Description | Manufacturer |
|---|---|---|---|
| T1 | IRF9530 | p-channel power MOSFET | Inter. React. |
| T2 | IRF510 | n-channel power MOSFET | Inter. React. |
| T3 | IRF9530 | p-channel power MOSFET | Inter. React. |
| T4 | IRF510 | n-channel power MOSFET | Inter. React. |
| D1 | 11DQ05 | power schottky diode | Inter. React. |
| D2 | 11DQ05 | power schottky diode | Inter. React. |
| D3 | IN3070 | high voltage diode | Texas Instru. |
| D4 | IN3070 | high voltage diode | Texas Instru. |
| Dc1 | IN3070 | high voltage diode | Texas Instru. |
| Dc2 | IN3070 | high voltage diode | Texas Instru. |
| INV | MM74CO4 | CMOS inverter | Nat. Semicon. |
| Td1 | MPS6531 | NPN transistor | Motor. Semicon. |
| Td2 | MPS6534 | PNP transistor | Motor. Semicon. |
| L | — | 2 μH air coil | J. W. Miller |
| Cp | — | 5 nF silver mica cap | — |
| Css | — | 1 μF/50 volt cap | — |
| C3 | — | 10 pF silver mica cap | — |
| C4 | — | 10 pF silver mica cap | — |
| Cg1 | — | .01 μF/100 volt cap | — |
| Cg2 | — | .01 μF/100 volt cap | — |
| Cg3 | — | .01 μF/100 volt cap | — |
| R1 | — | 100K ohm ¼ watt | — |
| R2 | — | 100K ohm ¼ watt | — |
| R3 | — | 33K ohm ¼ watt | — |

(All zener diodes shown are 12 volt).

In an experimental setup for measuring the efficiency of the prototype circuit in FIG. 9, the supply voltage (Vcc) and the supply current were accurately measured while the circuit was driving a 5 nF capacitor load (Cp). The load was driven at a frequency of f=50 kHz, with the supply voltage at 100 V. Thus, the normal power dissipation expected in this case was $$\begin{aligned} P_{lost} &= (\text{energy lost to charge } Cp + \\ &\quad \text{energy lost to discharge } Cp) \times f \\ &= (1/2CpVcc^2 + 1/2CpVcc^2) \times f = 2.5 \text{ W.} \end{aligned}$$

The measured supply current for the FIG. 9 circuit was 2.0 mA, so the actual power drawn from the supply and dissipated in the driver was 0.2 W. Thus, this circuit recovered all but 0.2 W of the normally lost power. The previously defined recovery efficiency is therefore 92%.

By comparison, the recovery efficiency predicted by analysis of the circuit model of FIG. 7 is 93%. This is an indication that the most significant sources of power loss in the real circuit of FIG. 9 have been accurately accounted for in the model of FIG. 7, and the model is a valid representation of the real circuit.

The sustain driver of FIG. 9 can be used on each side of an ISA plasma panel. As an example, each of the sustain drivers XSA, XSB, YSA, YSB, in FIG. 2 could be a sustain driver of FIG. 9, and could be used with the open-drain address drivers previously described in connection with FIGS. 1–4.

After testing two sustain drivers (each as shown in FIG. 9 with capacitor loads, one sustain driver was connected to each side of a 512×512 ac plasma display panel. It was found that these sustain drivers could drive the panel with 90% recovery efficiency when no pixels were "ON", and that with all of the pixels "ON", the dissipation was still low enough that heat sinks were not necessary. With all of the pixels "ON", the power dissipation in T1 and T2 did not change, but the power dissipation in T3 and T4 increased due to the $I^2R$ losses resulting from the flow of discharge current. This power dissipation can be lowered by using lower "ON" resistance devices for T3 and T4.

In testing the prototype sustain driver circuit of FIG. 9, it was found that this circuit continued to charge and discharge the panel at the sustain frequency with high recovery efficiency, regardless of large variations in the panel capacitance or in the inductance of the coil. This is a distinct advantage over prior proposed sustain driver circuits.

It may be possible to substitute bipolar power transistors for the power MOSFETs, T1 and T2 in FIG. 9 in a suitably designed circuit. Also, since the power dissipation and, hence, the cooling requirements have been significantly reduced in the sustain driver circuit of FIG. 9, if all of the sustainer electrodes can be economically integrated onto a single silicon chip, then the complete sustainer can be packaged into a single case with one heat sink.

Figure 10:
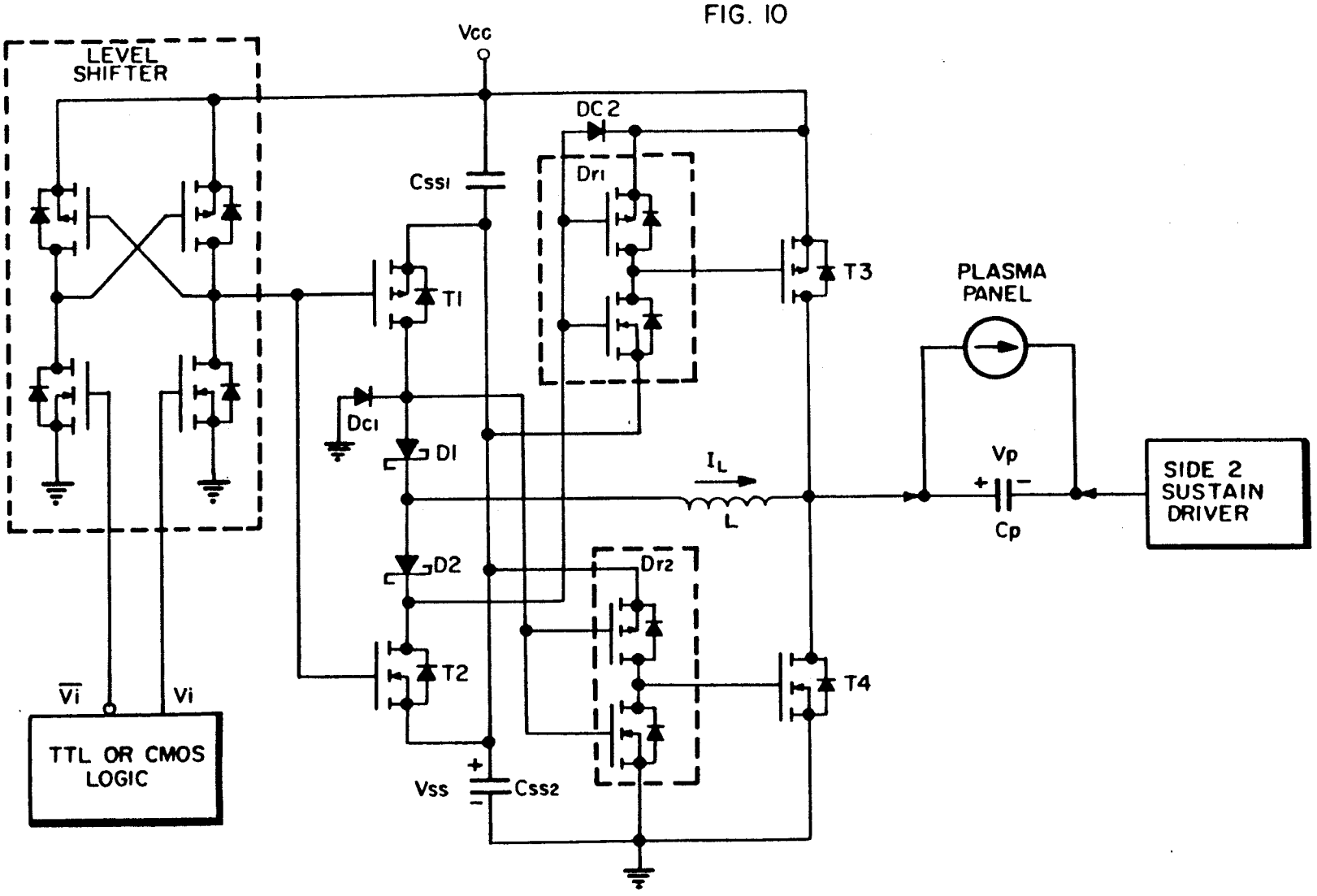
FIG. 10 is a schematic circuit diagram of a new sustain driver in an integrated circuit design.

With reference to FIG. 10, there is illustrated an integrated, power efficient sustain driver circuit according to the invention that does not require resistors or capacitors. In the circuit of FIG. 10, T1 and T2 are driven directly by the Level Shifter, T3 is driven directly from the CMOS Driver Dr1, and T4 is driven directly from the CMOS driver Dr2. If Css1, Css2 and the inductor are excluded from integration, then the integrated circuit is made up entirely of active components. Thus, the silicon area required is minimized.

The operation of this circuit is basically the same as the circuit of FIG. 9. As before, T1 and T2 charge and discharge Cp via L, and T3 and T4 clamp Vp at Vcc and ground, respectively. The difference is in the gate drive circuits Dr1, Dr2, and the Level Shifter, and in the addition of Css1.

Css1 and Css2 form a voltage divider where Css1=Css2. Thus, at power up, when Vcc begins to rise, Vss will rise at Vcc/2. Later, when Vss has risen above the threshold level of the MOSFETs, then Vss will be held at Vcc/2.

The Level Shifter is a set-reset latch, with its output at either Vcc or ground. When Vi switches "HIGH", the output of the Level Shifter drops to ground and forces −Vss across the gate to source of both T1 and T2. This turns T1 "ON" and T2 "OFF". The input to Dr2 is then forced to Vss, the output of Dr2 drops to ground, and T4 is turned "OFF". Later, when $I_L$ falls to zero and then reverses, the input to Dr1 rises from Vss to Vcc, the gate of T3 is then pulled down by Dr1 to Vss, and T3 turns "ON". Thus, Vp is driven to Vcc when Vi switches "HIGH".

When Vi switches "LOW", the output of the Level Shifter rises to Vcc and forces Vss across the gate to source of both T1 and T2. This turns T1 "OFF" and T2 "ON". The input to Dr1 is then forced to Vss, the output of Dr1 rises to Vcc and T3 is turned "OFF". Later when $I_L$ falls to zero and then reverses, the input to Dr2 falls from Vss to ground. The gate of T4 is then driven up by Dr2 to Vss, and T4 turns "ON".

Figure 11:
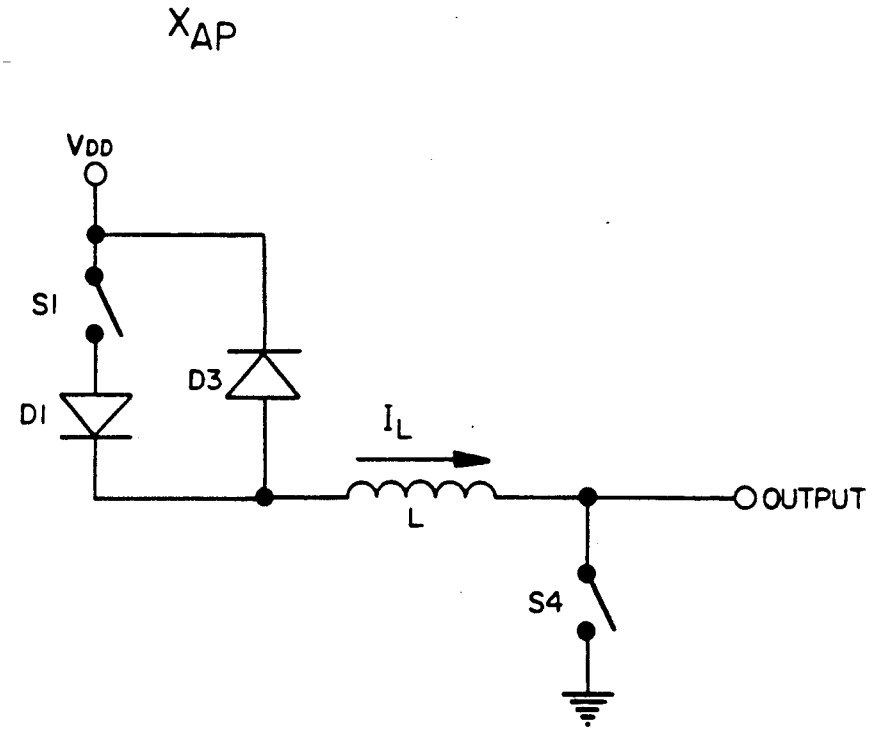
FIG. 11 is a schematic circuit diagram of an XAP address pulse driver incorporating energy recovery techniques according to the invention.
Figure 12:
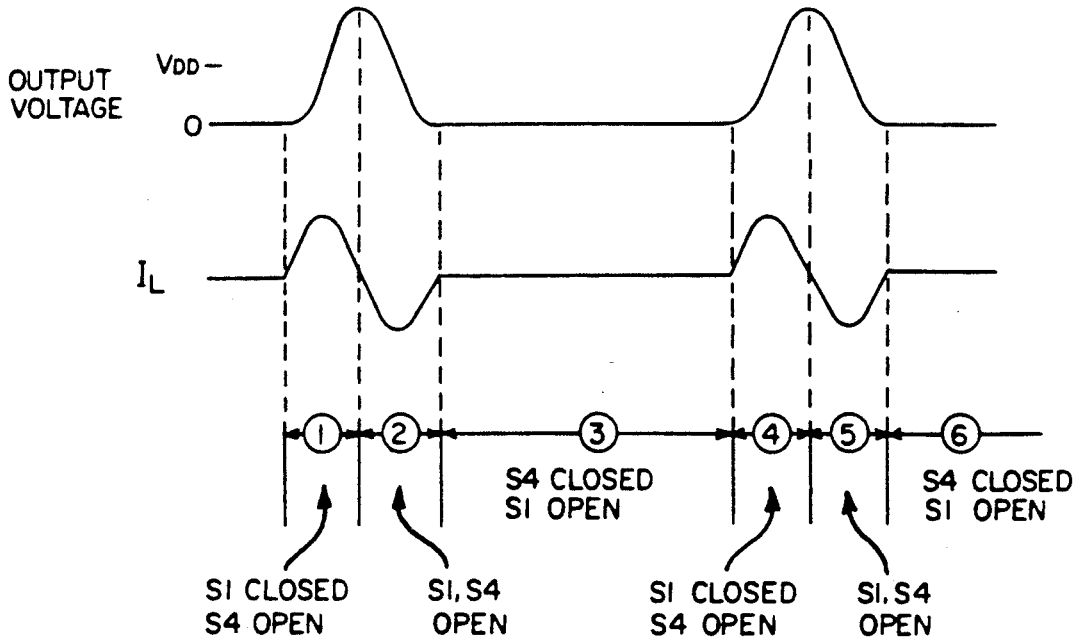
FIG. 12 are waveform diagrams useful in understanding the operation of FIG. 11.

The XAP and YAP address pulse generators may also be designed with the energy recovery technique previously described in connection with the sustain driver circuit. As an example, reference may be made to FIGS. 11-14. FIG. 11 illustrates an XAP address pulse generator connected to the panel electrodes at the output terminal. FIG. 12 illustrates the output voltage and inductor current waveforms (similar to FIGS. 5 and 6 with respect to the sustain driver) as switches S1 and S4 are opened and closed through the switching states. The output voltage waveform in FIG. 12 is a positive double pulse conforming to the desired XAP waveforms of FIGS. 3 and 4. Notice that switch S2 of FIG. 5 has been eliminated in the XAP generator of FIG. 11 since diode D3 diode D2 and S2 in FIGS. 5 and 6.

Figure 13:
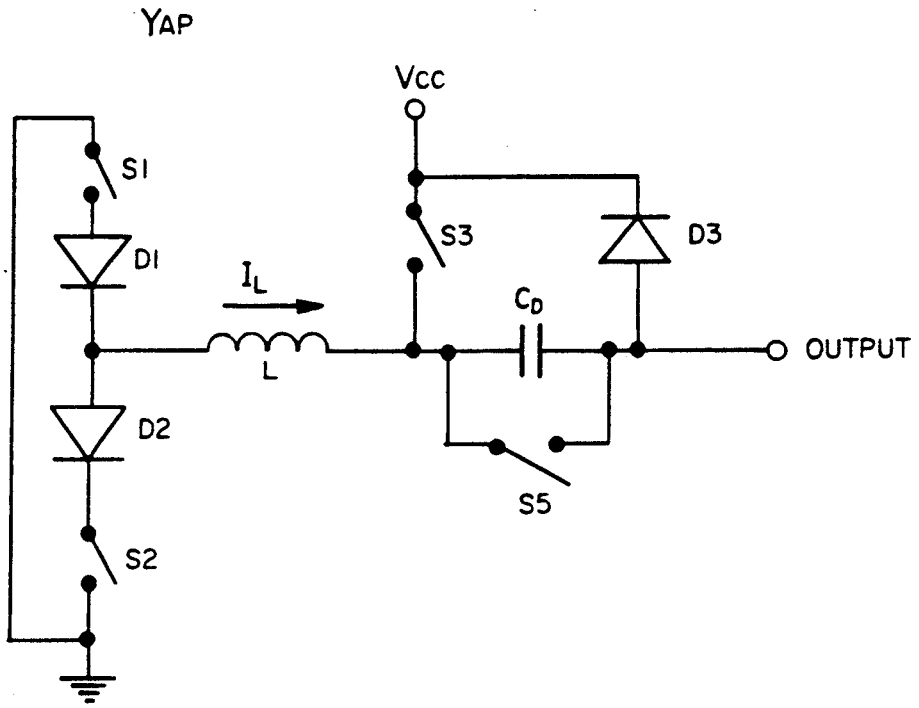
FIG. 13 is a schematic circuit diagram of YAP address pulse driver incorporating energy recovery techniques according to the invention.
Figure 14:
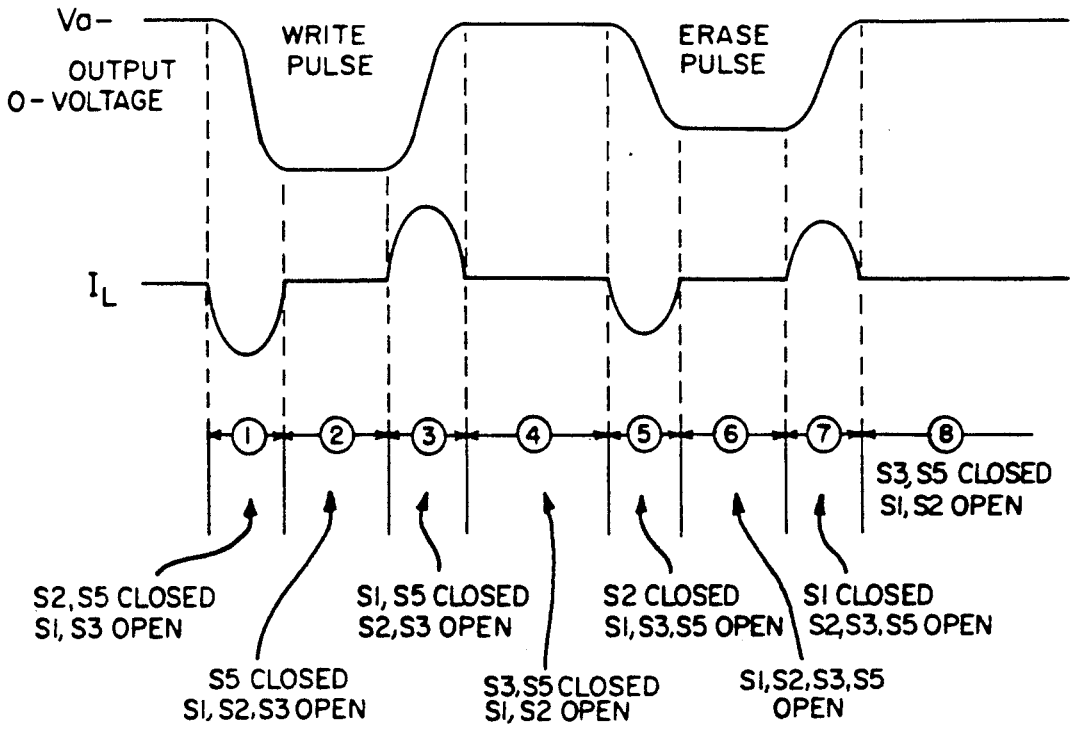
FIG. 14 are waveform diagrams useful in understanding the operation of FIG. 13.

FIG. 13 illustrates YAP generator and FIG. 14 illustrates the corresponding waveforms in the switching states. Capacitor $C_D$ and the output capacitance connected to the output terminal function as a voltage divider of voltage Vcc supplied to the circuit. When a Write Pulse is required (See FIG. 14), switch S5 is closed to short capacitor $C_D$ to provide the full amplitude Write Pulse to the panel. If an Erase Pulse is required, switch S5 is opened to provide the reduced amplitude Erase Pulse to the panel.

If desired, an ISA panel can be provided with N-channel MOSFET address drivers on one axis and P-channel MOSFET address drivers on the other axis, using techniques similar to the YAP and XAP address driver circuit techniques previously described. For example, a YAP address pulse generator with an N-channel MOSFET driver could be used with negative pulse similar to the negative pulses of the YAP pulses in FIG. 3. For the XAP address pulse generator a P-channel MOSFET driver could be used with a positive going single pulse having a pulse width equal to the width between the two double XAP pulses shown in the expanded view of FIG. 4.

The foregoing detailed description has ben given for clearness of understanding only, and no unnecessary limitations should be understood therefrom, as modifications will be obvious to those skilled in the art.

We claim:

1. Addressing apparatus for addressing cells defined by the intersection of respective address electrodes in respective arrays of X and Y dimension address electrodes in an ac plasma panel, said addressing apparatus comprising:

means for applying a high level pulse of one polarity to a plurality of address electrodes of one dimension array;

means for selective discharging of non-selected address electrodes of said plurality and maintaining the high level of one polarity at selected address electrodes of said plurality in accordance with desired information to be entered into the plasma panel; and means for applying a high level pulse of opposite polarity to respective address electrode of the other dimension array after said selective discharging of non-selected address electrodes for discharging cells at said selected address electrodes and entering the desired information into the plasma panel.

2. Addressing apparatus according to claim 1, including means for applying a second high level pulse of said one polarity to said plurality of address electrodes of said one dimension array after the end of said high level pulse of opposite polarity for enabling the controllable discharging of said selected address electrodes from said high level to said low level of said one polarity.

3. Addressing apparatus for addressing cells defined by the intersection of respective address electrodes in respective arrays of X and Y dimension address electrodes in an ac plasma panel, said addressing apparatus comprising:

means for charging a plurality of address electrodes of one dimension array to a high level of one polarity;

means for selective discharging of non-selected charged address electrodes of said plurality and maintaining the high level of one polarity at selected charged address electrodes in accordance with desired information to be entered into the plasma panel; and means for applying a high level of opposite polarity charge to a respective address electrode of the other dimension array after said selective discharging of non-selected charged address electrodes for discharging cells at said selected charged address electrodes and entering the desired information into the plasma panel.

4. Addressing apparatus according to claim 3, wherein said means for charging said plurality of address electrode of one dimension array includes means for applying a high level pulse of said one polarity to said plurality of address electrodes.

5. Addressing apparatus according to claim 3, including means for applying a high level pulse of said one polarity to said plurality of address electrodes of one dimension array after entering said desired information into the plasma panel for enabling the controllable discharging of said selected charged address electrodes from said high level to said low level of said one polarity.

6. Addressing apparatus according to claim 5, wherein said means for charging said plurality of address electrodes of one dimension array includes means for applying a high level pulse of said one polarity to said plurality of address electrodes.

7. A method of addressing address cells defined by the intersection of respective address electrodes in respective arrays of X and Y dimension address electrodes in an ac plasma panel, said method of addressing comprising the steps of:

charging a plurality of address electrodes of one dimension array to a high level of one polarity;

selective discharging of non-selected charged address electrodes of said plurality without discharging selected charged address electrodes of said plurality in accordance with desired information to be entered into the plasma panel; and applying a high level of opposite polarity charge to a respective address electrode of the other dimension array for discharging address cells associated with the selected charged address electrodes of said plurality and entering the desired information into the plasma panel.

8. The method of claim 7, wherein said charging includes applying a high level pulse of said one polarity to said plurality of address electrodes of one dimension array.

9. The method of claim 7, including the further step of applying a high level pulse of said one polarity to said plurality of address electrodes of one dimension array after entering said desired information into the plasma panel for enabling the controllable discharging of said selected charged address electrodes.

10. The method of claim 9, wherein said charging includes applying a first high level pulse of said one polarity to said plurality of address electrodes of one dimension array.

11. Addressing apparatus for addressing pixels defined by the intersection of respective address electrodes in respective arrays of X and Y dimension address electrodes in a display panel, said addressing apparatus comprising:

means for applying a high level pulse of one polarity to address electrodes of one dimension array;

means for selective discharging of non-selected address electrodes without discharging selected address electrodes in accordance with desired information to be entered into the display panel; and means for applying a high level pulse of opposite polarity to a respective address electrode of the other dimension array after said selective discharging for entering the desired information into the display panel.

12. Address apparatus according to claim 11, including means for applying a second high level pulse of said one polarity to said address electrodes of said one dimension array after the end of said high level pulse of opposite polarity for enabling the controllable discharging of said selected address electrodes.

13. Addressing apparatus for addressing pixels defined by the intersection of respective address electrodes in respective arrays of X and Y dimension address electrodes in a display panel, said addressing apparatus comprising:

means for charging address electrodes of one dimension array to a high level of one polarity;

means for selective discharging of non-selected charged address electrodes without discharging selected charged address electrodes to maintain the high level of one polarity at said selected charged address electrodes in accordance with desired information to be entered into the display panel; and means for applying a high level of opposite polarity charge to a respective address electrode of the other dimension array after said selective discharging of non-selected charged address electrodes for entering the desired information into the display panel.

14. Address apparatus according to claim 13, including means for applying a high pulse of said one polarity to said address electrodes of one dimension array after entering said desired information into the display panel for enabling the controllable discharging of said selected charged address electrodes from said high level to a low level of said one polarity.

15. A method of addressing address cells defined by the intersection of respective address electrodes in respective arrays of X and Y dimension address electrodes in a display panel, said method of addressing comprising the steps of:

charging address electrodes of one dimension array to a high level of one polarity;

selective discharging non-selected but not selected charged address electrodes in accordance with desired information to be entered into the display panel; and applying a high level of opposite polarity charge to a respective address electrode of the other dimension array after said selective discharging for entering the desired information into the display panel.

16. The method of claim 15, including the further step of applying a high level pulse of said one polarity to said address electrode of one dimension array after entering said desired information into the display panel for enabling the controllable discharging of said selected charged address electrodes.

17. A display panel comprising:

an array of X dimension address electrodes;

an intersecting array of Y dimension address electrodes, where intersections between respective X and Y address electrodes define respective display pixels;

address means for applying an addressing signal during an addressing cycle to selected X and Y address electrodes to activate at least one display pixel;

said address means including, means for charging more than one address electrode of said X or Y dimension array to a high level of one polarity;

means for selective discharging non-selected but not selected charged address electrodes in accordance with desired information to be entered into the display panel; and means for applying a high level pulse of opposite polarity to a respective address electrode of the other said X or Y dimension array after said selective discharging for entering the desired information into the display panel.

18. A display panel according to claim 17, including means for enabling controllable discharging of said address electrode from said high level of said one polarity after entering said desired information into the display panel.

19. An ac plasma panel comprising:

an array of X dimension electrodes;

an intersecting array of Y dimension electrodes with the intersections between respective X and Y electrodes defining a gas discharge cell;

address means for applying a signal to selected X and Y electrodes to discharge at least one gas discharge cell;

said address means including, means for charging more than one address electrode of said X or Y dimension array to a high level of one polarity;

means for selective discharging nonselected but not selected charged address electrodes to maintain the high level of one polarity at said selected charged address electrodes in accordance with desired information to be entered into the plasma panel; and means for applying a high level pulse of opposite polarity to a respective address electrode of the other said X or Y dimension array after said selective discharging for discharging said one gas discharge cell and entering the desired information into the plasma panel.

20. An ac plasma panel according to claim 19, including means for enabling controllable discharging of said selected charged address electrodes from said high level to a low level of said one polarity after entering said desired information into the plasma panel.

21. In display panels having panel electrodes and corresponding panel capacitance, an energy efficient method of driving said display panels through an inductor coupled to the panel electrodes comprising the steps of:

charging the panel capacitance through said inductor, initially while storing energy in said inductor until the magnitude of the inductor current reaches a maximum, and secondly while removing the stored energy from said inductor until the inductor current reaches zero; and discharging the panel capacitance through said inductor, initially while storing energy in said inductor until the magnitude of the inductor current reaches a maximum, and secondly while removing the stored energy from said inductor until the inductor current reaches zero.

22. The method of claim 21, wherein charging of the panel capacitance includes applying a forcing voltage which is about one-half the magnitude of the voltage level the panel capacitance reaches after charging.

23. The method of claim 22, wherein discharging of the panel capacitance includes applying a forcing voltage which is about one-half the magnitude of the voltage level the panel capacitance reaches after charging.

24. The method of claim 21, including the step of after discharging the panel capacitance, maintaining the panel capacitance in a discharging state prior to again charging the panel capacitance.

25. The method of claim 21, including the steps of after charging the panel capacitance, maintaining the panel capacitance in a charged state prior to discharge, and after discharge, maintaining the panel capacitance in a discharged state prior to again charging the panel capacitance.

26. The method of claim 25, wherein the step of maintaining the panel capacitance in a charged state includes clamping the voltage level of the panel capacitance upon the inductor current reaching zero, and wherein the step of maintaining the panel capacitance in a discharged state prior to again charging includes clamping the voltage level of the panel capacitance upon the inductor current reaching zero.

27. A display panel having panel electrodes and panel capacitance, an inductor coupled to the panel electrodes, and a driver circuit coupled to the inductor for operating the display panel through the inductor, the driver circuit including, means for charging the panel capacitance through said inductor, initially while storing energy in said inductor until the magnitude of the inductor current reaches a maximum, and secondly while removing the stored energy from said inductor until the inductor current reaches zero; and means for discharging the panel capacitance through said inductor, initially while storing energy in said inductor until the magnitude of the inductor current reaches a maximum, and secondly while removing the stored energy from said inductor until the inductor current reaches zero.

28. A display panel according to claim 27, wherein said means for charging the panel capacitance includes means for applying a forcing voltage which is about one-half the magnitude of the voltage level the panel capacitance reaches after charging.

29. A display panel according to claim 28, wherein said means for discharging the panel capacitance includes means for applying a forcing voltage which is about one-half the magnitude of the voltage level the panel capacitance reaches after charging.

30. A display panel according to claim 27, including means for maintaining the panel capacitance in a discharged state upon the inductor current reaching zero and prior to again charging the panel capacitance.

31. A display panel according to claim 27, including means for maintaining the panel capacitance in a charged state after charging the panel capacitance and prior to discharge, and means for maintaining the panel capacitance in a discharged state after discharge and prior to again charging the panel capacitance.

32. A display panel according to claim 31, wherein said means for maintaining the panel capacitance in a charged state includes means for charging the voltage level of the panel capacitance upon the inductor current reaching zero during charging of the panel capacitance, and wherein said means for maintaining the panel capacitance in a discharged state includes means for clamping the voltage level of the panel capacitance upon the inductor current reaching zero during discharging of the panel capacitance.

33. A display panel having panel electrodes and panel capacitance, and an energy recovery sustain circuit coupled to the panel electrodes for driving said display panel, said energy recovery sustain circuit including;

an inductor coupled to said panel electrodes for charging and discharging the panel capacitance;

means for charging the panel capacitance through said inductor, initially while storing energy in said inductor until the magnitude of the inductor current reaches a maximum, and secondly while removing the stored energy from said inductor until the inductor current reaches zero;

first means for clamping the voltage level of said panel capacitance upon the inductor current reaching zero during charging of the panel capacitance;

means for discharging the panel capacitance through said inductor, initially while storing energy in said inductor until the magnitude of the inductor current reaches a maximum, and secondly while removing the stored energy from said inductor until the inductor current reaches zero; and second means for clamping the voltage level of the panel capacitance upon the inductor current reaching zero during discharging of the panel capacitance.

34. A display panel according to claim 33, wherein said first and second means for clamping includes means responsive to the inductor current reaching zero to provide said clamping independent of variations in the values of said inductor or said panel capacitance.

35. An energy efficient driver circuit for driving display panels having panel electrodes and panel capacitance, said driver circuit comprising:

an inductor coupled to said panel electrodes for charging and discharging the panel capacitance;

means for charging the panel capacitance through said inductor, initially while storing energy in said inductor until the magnitude of the inductor current reaches a maximum, and secondly while removing the stored energy from said inductor until the inductor current reaches zero; and means for discharging the panel capacitance through said inductor, initially while storing energy in said inductor until the magnitude of the inductor current reaches a maximum, and secondly while removing the stored energy from said inductor until the inductor current reaches zero.

36. An energy efficient sustainer circuit for driving display panels having panel electrodes and panel capacitance, said sustainer circuit comprising an inductor coupled to said panel electrodes for charging and discharging the panel capacitance;

means for charging the panel capacitance through said inductor, initially while storing energy in said inductor until the magnitude of the inductor current reaches a maximum, and secondly while removing the stored energy from said inductor until the inductor current reaches zero; and first means for clamping the voltage level of the panel capacitance upon the inductor current reaching zero during charging of the panel capacitance;

means for discharging the panel capacitance through said inductor, initially while storing energy in said inductor until the magnitude of the inductor current reaches a maximum, and secondly while removing the stored energy from said inductor until the inductor current reaches zero; and second means for clamping the voltage level of the panel capacitance upon the inductor current reaching zero during discharging of the panel capacitance.

37. An energy efficient sustainer circuit according to claim 36, wherein said first and second means for clamping includes means responsive to the inductor current reaching zero to provide said clamping independent of variations in the values of said inductor or said panel capacitance.

38. An energy efficient driver circuit for driving display panels having panel electrodes and panel capacitance, said driver circuit comprising:

an inductor coupled to said panel electrodes for charging and discharging said panel capacitance respectively to and from a desired voltage level magnitude;

first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor; and second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor.

39. An energy efficient driver according to claim 38, including third switch means coupled to said inductor for clamping the panel capacitance voltage level to maintain a panel capacitance discharged state until the panel capacitance is again charged.

40. An energy efficient driver according to claim 38, including third switch means coupled to said inductor clamping the panel capacitance voltage to said desired voltage level magnitude after charging of said panel capacitance, and fourth switch means coupled to said inductor for clamping the panel capacitance voltage to said first voltage level magnitude after discharging of said panel capacitance.

41. An energy efficient driver according to claim 40, wherein said third switch means and said fourth switch means each respectively includes means responsive to the end of the removal of said stored energy from said inductor to provide said respective clamping independent of variations in the value of said inductor or said panel capacitance.

* * * * *

UNITED STATES PATENT AND TRADEMARK OFFICE

CERTIFICATE OF CORRECTION

PATENT NO. : 5,081,400

DATED : January 14, 1992

INVENTOR(S) : LARRY F. WEBER, ET AL.

It is certified that error appears in the above-identified patent and that said Letters Patent is hereby corrected as shown below:

Col. 2, line 20, change "addressing river" to --addressing driver--.

Col. 6, line 31, change "logic gates that ar" to --logic gates that are--; and change "control th" to --control the--.

Col. 8, line 17, change "supplying th" to --supplying the--.

Col. 8, line 20, change "circuit ca" to --circuit can--.

Col. 10, line 8, change "$V_S$s" to --Vss--.

Col. 10, line 20, after "closed" insert --,--.

Col. 11, line 33, change "RL." to --$R_L$.--.

Col. 11, line 50, change "RL" to --$R_L$--.

Col. 11, line 64, change "(V2-VL)" to --(V2-$V_L$)--.

UNITED STATES PATENT AND TRADEMARK OFFICE

CERTIFICATE OF CORRECTION

PATENT NO. : 5,081,400

DATED : January 14, 1992

INVENTOR(S) : LARRY F. WEBER, ET AL.

It is certified that error appears in the above-identified patent and that said Letters Patent is hereby corrected as shown below:

Col. 12, line 22, change "FIG. predicted" to --FIG. 8 predicted--.

Col. 13, line 11, change "$V_p$" to --Vp--.

In the Claims:

Col. 18, line 17, change "Address apparatus" to --Addressing apparatus--.

Col. 18, line 42, change "Address apparatus" to --Addressing apparatus--.

Col. 18, line 43, change "high pulse" to --high level pulse--.

Col. 20, line 15, change "discharging state" to --discharged state--.

UNITED STATES PATENT AND TRADEMARK OFFICE

CERTIFICATE OF CORRECTION

PATENT NO. : 5,081,400

DATED : January 14, 1992

INVENTOR(S) : Larry F. Weber, et al.

It is certified that error appears in the above-identified patent and that said Letters Patent is hereby corrected as shown below:

Column 20, line 15, change "discharging state" to --discharged state--.

Signed and Sealed this

Seventeenth Day of August, 1993

Bruce Lehman

*Attest:*

BRUCE LEHMAN

*Attesting Officer*

*Commissioner of Patents and Trademarks*

US005081400C1

(12) EX PARTE REEXAMINATION CERTIFICATE (5689th)

United States Patent
Weber et al.

(10) Number: US 5,081,400 C1
(45) Certificate Issued: Mar. 6, 2007

(54) POWER EFFICIENT SUSTAIN DRIVERS AND ADDRESS DRIVERS FOR PLASMA PANEL

(75) Inventors: Larry F. Weber, Champaign, IL (US); Kevin W. Warren, Champaign, IL (US); Mark B. Wood, Woods Cross, UT (US)

(73) Assignee: The Board of Trustees of the University of Illinois, Urbana, IL (US)

Reexamination Request:
No. 90/006,396, Oct. 11, 2002
No. 90/006,610, Apr. 18, 2003

Reexamination Certificate for:

| | |
|---|---|
| Patent No.: | **5,081,400** |
| Issued: | **Jan. 14, 1992** |
| Appl. No.: | **07/338,111** |
| Filed: | **Apr. 14, 1989** |

Certificate of Correction issued Aug. 17, 1993.

Related U.S. Application Data

(63) Continuation of application No. 06/911,396, filed on Sep. 25, 1986, now Pat. No. 4,866,349.

(51) Int. Cl.
*G09G 3/10* (2006.01)

(52) U.S. Cl. ..... 315/169.4; 315/169.3; 315/169.1; 315/209 R; 315/242; 345/208; 345/204; 345/214; 345/76

(58) Field of Classification Search ... 315/169.1–169.4, 315/242, 226, 209 CD, 241 R, 227 R; 345/76, 345/204, 210, 211, 214
See application file for complete search history.

(56) References Cited

U.S. PATENT DOCUMENTS

| | | | |
|---|---|---|---|
| 3,343,128 A | 9/1967 | Rogers | |
| 3,559,190 A | 1/1971 | Bitzer et al. | 315/169.1 |
| 3,601,531 A | 8/1971 | Bitzer et al. | |
| 3,601,532 A | 8/1971 | Bitzer et al. | |

(Continued)

FOREIGN PATENT DOCUMENTS

| | | |
|---|---|---|
| EP | A 2-0 044 182 | 1/1982 |

(Continued)

OTHER PUBLICATIONS

Prosecution History of European Pat. Appln. 93103698.2, including Fujistsu opposition, Weber, et al.

(Continued)

*Primary Examiner*—Haissa Philogene

(57) ABSTRACT

An improved address driver circuit for plasma panels, particularly useful with an independent sustain and address plasma panel. Address pulse generators for one panel address axis are coupled to MOSFET driver devices and provide pulses of a first polarity; and address pulse generators for the other panel address axis are coupled to similar MOSFET driver devices and provide double pulses of a second polarity. With N-channel open-drain MOSFET drivers on both panel address axes, they only need to be designed to pull low. An improved power efficient sustain driver for plasma panels including an inductor through which the panel capacitance is charged and discharged, and switch means switched when the inductor current is zero, which permits recovery of the energy otherwise lost in driving the panel capacitance. An independent sustain and address plasma panel with such energy efficient address drivers and sustain drivers. The energy efficient sustain driver can be used with plasma display panels, electroluminescent panels and with liquid crystal panels having inherent panel capacitance. An independent sustain and address panel with N-channel MOSFET drivers on one address axis and P-channel MOSFET drivers on the other address axis, with an address pulse generator providing pulses of a first polarity to the N-channel MOSFETs, and another address pulse generator providing pulses of a second polarity to the P-channel MOSFETs.

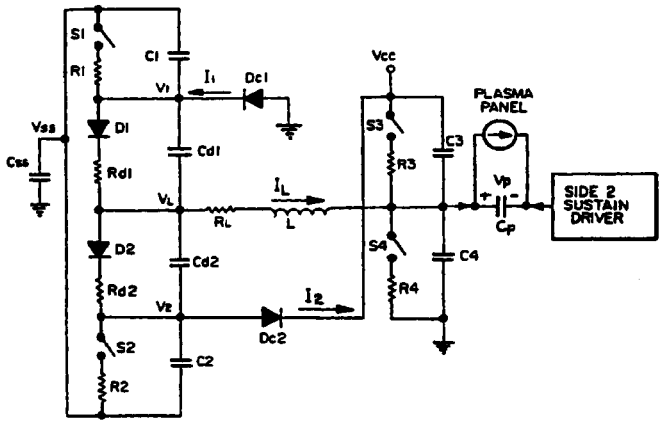

U.S. PATENT DOCUMENTS 3,626,244 A 12/1971 Holz ..... 345/70
3,654,388 A 4/1972 Slottow et al.
3,654,537 A 4/1972 Coffey
3,659,190 A 4/1972 Galluppi
3,702,434 A 11/1972 Ryan
3,749,977 A 7/1973 Sliker
3,771,040 A 11/1973 Fletcher et al.
3,777,182 A 12/1973 Peters
3,777,183 A 12/1973 Peters
3,780,339 A 12/1973 Mayle ..... 315/1
3,786,485 A 1/1974 Wojcik
3,821,596 A 6/1974 Leuck
3,821,599 A 6/1974 Peters
3,821,606 A 6/1974 Buozynski
3,833,833 A 9/1974 Nelson
3,836,838 A 9/1974 Homer et al.
3,859,560 A 1/1975 Peters
3,869,644 A 3/1975 Yano et al.
3,890,562 A 6/1975 West
3,914,617 A 10/1975 Corbel
3,924,172 A 12/1975 Gregorich
3,931,528 A 1/1976 Farnsworth et al.
3,935,529 A 1/1976 Kalmanash et al.
3,953,785 A 4/1976 Bell, Jr.
3,967,157 A 6/1976 Hada et al.
3,987,337 A 10/1976 Nishida et al.
3,991,416 A 11/1976 Byles et al.
4,021,607 A 5/1977 Amano
4,024,429 A 5/1977 Glaser
4,070,663 A 1/1978 Kanatani et al. ..... 345/76
4,073,003 A 2/1978 Chambers
4,073,004 A 2/1978 Chambers et al.
4,091,309 A 5/1978 Strom
4,092,566 A 5/1978 Chambers et al.
4,099,097 A 7/1978 Schermerhorn et al.
4,100,535 A 7/1978 Bitzer et al.
4,122,514 A 10/1978 Amin
4,131,939 A 12/1978 Day
4,140,944 A 2/1979 Miller
4,143,297 A 3/1979 Fischer
4,176,392 A 11/1979 Cronin et al.
4,180,762 A 12/1979 Weber
4,189,729 A 2/1980 Baker et al.
4,203,055 A 5/1980 Chambers et al.
4,227,123 A 10/1980 Dietz
4,238,793 A 12/1980 Hochstrate
4,245,285 A 1/1981 Weiss
4,253,049 A 2/1981 Frame et al.
4,253,097 A 2/1981 Hochstrate
4,254,362 A 3/1981 Tulleners
4,268,898 A 5/1981 Brown
4,277,728 A 7/1981 Stevens
4,286,314 A 8/1981 Molyneaux-Berry
4,300,090 A 11/1981 Weber
4,303,918 A 12/1981 Reagan et al.
4,316,123 A 2/1982 Kleen et al.
4,333,138 A 6/1982 Huber
4,347,509 A 8/1982 Hardway et al.
4,349,816 A 9/1982 Miller et al.
4,392,084 A 7/1983 Rebeschi et al.
4,405,889 A 9/1983 Overstreet et al.
4,405,975 A 9/1983 Overstreet et al.
4,446,513 A 5/1984 Clenet
4,485,379 A 11/1984 Kinoshita et al.
4,492,957 A 1/1985 Marentic
4,496,879 A 1/1985 Suste
4,523,189 A 6/1985 Takahara et al.
4,527,096 A 7/1985 Kindlmann
4,550,274 A 10/1985 Weber ..... 315/169.4
4,553,039 A 11/1985 Stifter
4,570,159 A 2/1986 Criscimagna et al.
4,574,280 A 3/1986 Weber
4,574,342 A 3/1986 Runyan
4,595,920 A 6/1986 Runyan
4,635,052 A 1/1987 Aoike et al.
4,682,233 A 7/1987 Hinn
4,684,849 A 8/1987 Otsuka et al.
4,707,692 A 11/1987 Higgins et al. ..... 345/204
4,728,864 A 3/1988 Dick
4,733,228 A 3/1988 Flegal
4,737,687 A 4/1988 Shinoda et al.
4,772,884 A 9/1988 Weber et al.
4,855,891 A 8/1989 Paul
4,855,892 A 8/1989 Lower
4,900,987 A 2/1990 Otsuka et al.
4,924,218 A 5/1990 Weber et al.
5,089,755 A 2/1992 Wilber

FOREIGN PATENT DOCUMENTS

EP A 2-0 071 260 2/1983
EP 0 078 648 5/1983
JP 48-29363 4/1973
JP S51-71730 6/1976
JP 51-71730 6/1976
JP 51-77027 7/1976
JP 51-115734 10/1976
JP S52-95156 6/1977
JP 58-53344 3/1983
JP 58-53344 11/1983
JP 59-113237 6/1984
JP 59-137992 8/1984

OTHER PUBLICATIONS

Ronald E. Scott, "Part I Time–Domain Analysis Addison Wesley", Linear Circuits, 1960.

E. J. Angelo, Jr., "Electronic Circuits: A Unified Treatment of Vacuum Tubes and Transistors, Second Edition", McGraw–Hill, 1964.

Millman, et al., "Pulse, Digital and Switching Waveforms: Devices and Circuits for Their Generation and Processing", pp. 262–305; pp. 745–794, McGraw–Hill, 1965.

Bitzer, et al., "Progress Report for Sep. 1967 Through Feb. 1968. 9. Plasma Display", pp. 171–184, Coordinated Science Laboratory University of Illinois Archives (Plato–Cerl).

R. H. Wilson, "The Plasma Display", Information Display, pp. 39–44, Nov./Dec. 1968.

Oberg, et al., "Plasma Display Phase Select", Information Display, pp. 39–44, Mar./Apr. 1969.

Owaki, et al., "Plasma Display Harmonics Phase Selection", Information Display, pp. 47–48, May 1970.

Nakayama, et al., "Design of A Plasma Display Panel", Information Display, pp. 24–31, May 1970.

Author Unknown, "1971 SID International Symposium & Exhibition Agenda", Information Display, pp. 21–23, Mar./Apr. 1971.

Johnson, et al., "A ¼–Million–Element AC Plasma Display with Memory", SID Digest, pp. 108–109, May 1971.

D. T. Ngo, "Gray–scale Plasma Display", SID Digest, pp. 100–101, May 1971.

G. W. Dick, "Low–Cost Access Circuits for the Gas Plasma Display Model", SID Digest, pp. 104–105, May 1971.

L. F. Weber, "Optical Write–In Techniques for the Plasma Display Panel", Coordinated Science Laboratory UILU–ENG 71–2213 Report for Contract DAAB–07–67–C–0199, May 1971.

G. W. Dick, "Low Cost Drivers For Capacitively Coupled Gas Plasma Display Panels", SID, vol. 13/1, pp. 6–13, First Quarter 1972.
J. Strifle, "The Plato IV Student Terminal", SID, vol. 13/1, pp. 35–42, First Quarter 1972.
Johnson, et al., "A Quarter–Million Element AC Plasma Display With Memory", SID, vol. 13/1, pp. 56–60, First Quarter 1972.
Weber, et al., "Simple Access Circuitry for Electrical Data Sensing of Plasma Display/Memory Panels", SID Digest, pp. 136–137, Jun. 1972.
D. E. Liddle, "A Parallel Addressed, Multiplexed–Driver Plasma Display", SID Digest, pp. 40–41, Jun. 1972.
Umeda, et al., "Self–Shift Plasma Display"; SID Digest, pp. 38–39, Jun. 1972.
G. E. Holz, "Pulsed Gas Discharged Display with Memory", SID Digest, pp. 36–37, Jun. 1972.
Veron, et al., "Numerical Computation of the Temporal Development of the Current in an AC Plasma Panel"; SID Digest, pp. 34–35, Jun. 1972.
Weber, et al., "A Gas Display Panel with Quasi–Axial Electrode Configurations", SID Digest, pp. 32–33, Jun. 1972.
Nakayama, et al., "Low–Voltage Plasma Panel", SID Digest, pp. 30–31, Jun. 1972.
Umeda, et al., "A Storage Oscilloscope with Plasma Display Panel", Information Display, pp. 14–16, Nov./Dec. 1972.
A. H. Agajanian, "A Bibliography on Display Technologies", SID, vol. 14/2, pp. 76–80, Second Quarter 1973.
Takashima, et al., "Surface Discharge Type Plasma Display Panel", SID Digest, pp. 76–77, May 1973.
Ernsthausen, et al, "A Megabit Plasma Display Panel", SID Digest, pp. 74–75, May 1973.
Kurahashi, et al., "Plasma Display with Gray Scale", SID Digest, pp. 73–73, May 1973.
Umeda, et al., "Picture Display with Gray Scale in the Plasma Panel", SID Digest, pp. 70–71, May 1973.
Hoehn, et al., "Three–Color Plasma–Panel Display Device", Research and Development Technical Report ECOM–0243–7–F, United States Army Electronics Command—Fort Monmouth, NJ, May 1973.
Fukushima, et al., "Color–TV using a Flat Gas–Discharge Panel", SID Digest, pp. 120–121, May 1974.
J. D. Schermerhorn, "Internal Random Access Address Decoding in an AC Plasma Display Panel", SID Digest, pp. 22–23, May 1974.
Lustig, et al., "The Multilayer Gas–Discharge Display Panel", SID Digest, pp. 128–129, May 1974.
G. W. Dick, "Single Substrate AC Plasma Display", SID Digest, pp. 124–125, May 1974.
A. H. Agajanian, "A Bibliography on Plasma Display Panels", SID, vol. 15/4, pp. 170–175, Fourth Quarter 1974.
Tottori, et al., "A Driving Circuit for Plasma Display Panels", SID 75 Digest, vol. 6, pp. 118–119, Apr. 1975.
Murase, et al., "A Driving Technique to Stabilize AC Plasma Display", SID Digest, pp. 120–121 Apr. 1975.
T. N. Criscimagna, "Low Voltage Selection Circuits for Plasma Display Panel", SID Digest, pp. 116–117, Apr. 1975.
L. F. Weber, "Discharge Dynamics of the AC Plasma Display Panel", Coordinated Science Laboratory UILU–ENG 75–2222 Report for Contract DAAB–07–72–C–0259, Aug. 1975.
T. N. Criscimagna, "Low Voltage Circuits for Plasma Display Panel", SID, vol. 17/3, pp. 124–129, 1976.
Criscimagna, et al., "Coupled–Matrix, Threshold–Logic AC Plasma Display Panel", SID 76 Digest pp. 86–87, 1976.
A. Sobel, "Gas–Discharge Displays: The State of the Art", IEEE & SID Display Conference, pp. 99–109, Oct. 1976.
L. F. Weber, "Measurement of Wall Charge and Capacitance Variation for a Single Cell in the AC Plasma Display Panel", IEEE & SID Biennial Display Conferennce, pp. 39–44, Oct. 1976.
Tucker, et al., "A Minimum Component Per Line Technique for Addressing Plasma Displays", SID 77 Digest, pp. 22–23, 1977.
Johnson, et al., "Plasma Display/Memory Panel with Integral Drive Circuitry", SID 77 Digest, pp. 20–21, 1977.
Czajkowski, et al., "A Microcomputer Driven Graphic Display System Using the 1024×1024 Line (83 1 pi) AC Plasma Display Panel", SID 77 Digest, pp. 26–27, 1977.
J. W. V. Miller, "Optimization of AC Plasma Panel Waveforms", SID 77 Digest, pp. 24–25, 1977.
W. Archuleta, "Plasma Panel Displays Find Extensive Markets", Information Display, Sep., 1978.
G. W. Dick, "A Planar Single–Substrate AC Plasma Display with Capacitive Vias", SID, vol. 20/5, pp. 233–232, 1979.
W. F. Goede, "A Review of Display Technology Development in Japan", Information Display, Jan. 1979.
Weber, et al., "A Real–Time Curve Tracer for the AC Plasma Display Panel", IEEE Transactions on Electron Devices, vol. ED–26, No. 8, pp. 1156–1163, Aug. 1979.
Shinoda, et al., "Low–Voltage Operated AC Plasma–Display Panels", IEEE Transactions on Electron Devices, vol. ED–26, No. 8, pp. 1164–1167, Aug. 1979.
Author Unknown, "Interstate Electronics President Richard Forster shows the company's PM 512–60 plasma panel", Information Display Sep./Oct. 1979.
Author Unknown, "Flat Panel Displays—What are They and Why?", Information Display, Jan. 1980.
J. C. Greeson, "AC Plasma Technologies and Characteristics", SID Seminar Lecture, vol. 2, pp. 102–123, May 2, 1980.
Criscimagna, et al., "Write and Erase Waveforms for High Resolution AC Plasma Display Panels", IEEE & SID 1980 Biennial Display Research Conference, pp. 31–39, Oct. 1980.
Coleman, et al., "Device Characteristics of the Plasma Charge Transfer Shift Display", IEEE & SID 1980 Biennial Display Research Conference, pp. 64–71, Oct. 1980.
J. H. J. Lorteije, "Switching Bias Voltages for Multiplexing LC Matrix Displays", Proceedings of the First European Display Research Conference of SID, pp. 209–212, Sep. 1981.
Amano, et al., "A High–Resolution DC Plasma Display Panel", SID 82 Digest, pp. 160–161, 1982.
Miller, et al., "A High–Efficiency Drive Method for Electroluminescent Matrix Displays", SID, vol. 23/2, pp. 85–89, 1982.
Smalter, et al., "Integrated AC Plasma Display Panels", SID 82 Digest, pp. 260–261, 1982.
Smith, et al., "An EL Drive System with Low–Voltage Output Stages", SID 82 Digest, pp. 262–263, 1982.
D. R. Willis, "Tactical Plasma Display System", Information Display, Mar. 1, 1982.
L. F. Weber, "A New Gas Discharge Logic Technique that Reduces the Number of Circuit Drivers for AC Plasma Display Panels", University of Illinois Archives (Plato–Cerl), Preliminary Draft, Mar. 31, 1982.

T. Lucas, "Exhibitor's Corral at SID 82", Information Display, pp. 3–5, Jun. 1, 1982.
Yamaguchi, et al., High Speed and High Resolution Self–Shift Plasma Display, IEEE & SID 1982 International Display Research Conference, pp. 80–83, Oct. 1, 1982.
Author Unknown, Papers from the Second International Display Research Conference (1982), SID, vol. 24/2, 1983.
Weber, et al., "Two Equal–Brightness On–States in AC Plasma Displays Driven by Conventional Sustain Waveforms", SID 83 Digest, pp. 132–133, 1983.
W. Goede, "Technologies for High–Resolution Color Display", Information Display, pp. 4–6; 8, Jan. 1983.
Author Unknown, "Chapter News", Information Display, Apr. 1983.
T. L. Credelle, "Guided–Beam Displays for Large Screen Flat–Panel Color TV", Information Display, May 1983.
Aitken, et al., "Applications of Plasma Display Panels in Military C31 Systems Environments", Information Display, Jun. 1983.
Uchike, et al., "Improved Surface Discharge AC–Plasma Display Panels with New Electrode Structure", Japan Display '83, Proceedings of the SID 3rd International Display Research Conference, Kobe, pp. 258–261, Oct. 1, 1983.
Weber, et al., "A New Gas Discharge Logic Technique that Reduces Circuit Complexity for AC Plasma Display Panels", Japan Display '83, Proceedings of the SID 3rd International Display Research Conference, Kobe, pp. 502–505, Oct. 1, 1983.
Weber, et al., "Domains in AC Plasma AND Gates", SID 84 Digest, pp. 180–183, 1984.
Sakuma, et al., "An AC–Refresh Panel with High–Voltage CMOS Drivers and Unbalanced Power Supplies", SID 84 Digest, pp. 99–102, 1984.
Delgrange, et al., "A High–Voltage IC Driver for Large–Area AC Plasma Display Panels", SID 84 Digest, pp. 103–106, 1984.
P. Pleshko, "IBM's 581 AC Plasma Display Technology", SID 84 Digest, pp. 164–167, 1984.
Shinoda, et al., "Logically Addressable Surface Discharge AC Plasma Display Panels with a New Write Electrode", SID 84 Digest, pp. 172–175, 1984.
Sutton, et al., "Bringing New Technology to an Old Industry", Information Display, Apr. 1984.
C. Zhegen, "A Large Screen AC Plasma Display", SID Fourth Display Research Conference, Paris, pp. 165–168, Sep. 1, 1984.
Deschamps, et al., "A High–Resolution 1024×1024 Point Plasma Display Panel with Integrated Electronics", SID Fourth Display Research Conference, Paris pp. 161–164, Sep. 1, 1984.
L. F. Weber, "Address Technique Improvements for the AC Plasma Display Panel, Oct. 20, 1984", University of Illinois Archives, (Plato–Cerl), 1984.
Kevin Wilson Warren, "Real Time Computer Controlled Waveform Characterization of AC Plasma Displays", Thesis submitted in partial fulfillment of the requirements for the degree of Master of Science in Electrical Engineering in the Graduate College of the University of Illinois at Urbana–Champaign, 1984.
L. F. Weber, "L. E. Tannas, Flat–Panel Displays & CRT's", Chapter 10, Van Nostrand Reinhold Co, 1985.
M. L. Higgins, "A Low–Power Drive Scheme for AC TFEL Displays", SID International Symposium Digest of Technical Papers, vol. 16, pp. 226–228, 1985.
L. F. Weber, "SID 85 Session XIX, Plasma and Vacuum Fluorescent Displays", SID 85 Digest, pp. 349–350, 1985.
Criscimagna, et al., "A 960×768 Pel AC Plasma Panel Operating in Video Mode from an IBM Personal Computer", SID 85 Digest, pp. 354–357, 1985.
Author Unknown, "SID 85: Preview of Technical Papers", Information Display, pp. 19–36, Mar. 1985.
Author Unknown, "Chapter Notes & New SID Members", Information Display, p. 30, Apr. 1985.
Author Unknown, "Electronic Displays '85", Information Display, Jun. 1985.
M. L. Higgins, "High–Quality Electroluminescent Display for a Personal Workstation", Hewlett–Packard Journal, vol. 36, No. 10, pp. 12–17, Oct. 1985.
E. Schlam, "Flat–Panel Displays Poised to Displace Some CRT Applications", Information Display, pp. 11, Dec. 1985.
Weber, et al., "12.3 Independent Sustain and Address Techniques for the AC Plasma Display Panel", SID 86 Digest, pp. 220–223, May 1986.
Weber, et al., "Quantitative Wall Voltage Characteristics of AC Plasma Displays", SID, vol. 27/3, pp. 173–182, 1986.
Author Unknown, "Papers from the 1985 International Display Research Conference: vol. 11—Emissive and Non–Emissive Flat–Panel Displays", with forward by Paul M. Alt. Includes biography of Larry Weber, SID vol. 27/3, pp. 161–162, 1986.
G. W. Dick, "Three–Electrode–Per–Pel AC Plasma Display Panel", IEEE Proceedings of the SID, vol. 27/3, pp. 183–187, 1986.
Lee, et al., "High–Speed Asynchronous Video Addressing of AC–Plasma Display Incorporating Brightness Control", SID 86 Digest, pp. 399–402, 1986.
Otsuka, et al., "Characteristics and Performance of an Integral Capacitive–Matrix AC Plasma Display", SID 86 Digest, pp. 224–226, 1986.
Dick, et al., "A Three–Electrode AC Plasma HVCMOS Drive Scheme", SID 86 Digest, pp. 212–215, 1986.
Author Unknown, "SID 86: Preview of Technical Papers", Information Display, pp. 21–26, Mar. 1986.
Author Unknown, "SID 86 Highlights: Bigger, better, flatter systems on display at SID 86", Information Display, pp. 18–23, Apr. 1986.
G. W. Dick, "Three–electrode Plasma Panel Cuts Power Requirements", Information Display, vol. 2, pp. 18–20, May 1986.
Mark B. Wood, "A Power Efficient Sustainer for the AC Plasma Display", Thesis in partial fulfillment of Master of Science, Department of Electronic Engineering, University of Illinois at Urbana–Champaign, 1986.
Weber, et al., "A 512×512 Independent Sustain and Address Plasma Display", Japan Display 86, Proceedings of the SID Sixth International Display Research Conference, Tokyo, pp. 496–499, Sep. 30, 1986.
Weber, et al., "Energy Recovery Sustain Circuit for the AC Plasma Display", SID 87 Digest, pp. 92–95, 1987.
L. F. Weber, "Plasma Displays for Portable Computers", Information Display, vol. 4, No. 4, pp. 11–20, Apr. 1988.
S. Mikoshiba, "Plasma Displays", Information Display, vol. 4, No. 7 & 8, pp. 14–18, Jul./Aug. 1988.
J.L. Kehoe, "Plasma Technology", Information Display, vol. 4/12, pp. 12–13, Dec. 1988.
L. F. Weber, "Plasma Displays", Lecture Notes, SID Seminar 5, Baltimore, May 15, 1989.

Author Unknown, "Plasma Display (Japanese)", ISBN 320–08449–7, Nov. 15, 1983.
H. G. Slottow, "The Plasma Display Panel, U008881–88", University of Illinois Archives (Plato–Cerl), Date Unknown.
L. F. Weber, Discharge Physics Studies for the AC Plasma Display Panel, U008978–84, University of Illinois Archives (Plato–Cerl), Date Unknown.
Marvin L. Higgins, "A Low–Power Drive Scheme for AC TFEL Displays," 1985 SID Digest, pp. 226–228.
English Translation of Japanese Patent No. 58–5344, 15 pages.
English Translation of Japanese Patent No. 51–71730, 11 pages.
Higgins, M. (Oct. 1985) "High–Quality Electroluminescent Display for a Personal Workstation".
Uchiike, et al, "Analysis of Discharge Mechanism with Self–Shift Plasma Display Panels". IEEE & SID 1980 Biennial Display Research Conference, pp. 72–78, Oct. 1980.
Fujitsu Limited's Third Party Request for Reexamination, submitted Apr. 18, 2003.
Minutes of the public oral proceedings before Technical Board of Appeal 3.4.2 of Sep. 26, 2002, issued Oct. 2, 2002.
Decision of the Technical Board of Appeal 3.4.2 of Sep. 26, 2002, issued Oct. 30, 2002.
University's Opening Claim Construction Brief, dated Feb. 24, 2003 (with supporting declaration & exhibits).
Defendants' Responsive Claim Construction Brief, dated Mar. 10, 2003 (with supporting declaration & exhibits).
University of Illinois' Reply Claim Construction Brief, dated Mar. 24, 2003 (with supporting declaration & exhibits).
Defendant's and Counterclaimants' Motion for Summary Judgment of Invalidity re the '349 patent, dated Mar. 10, 2003.
University of Illinois' Opposition to Fujitsu's Motion for Summary Judgment of Invalidty re the '349 patent, dated Mar. 24, 2003.
Fujitsu's Reply Summary Judgment Brief re Invalidity re the '349 patent, dated Mar. 31, 2003.
Joint Claim Construction and Prehearing Statement, dated Dec. 6, 2002.
Transcript of Deposition of Umran S. Inan, Ph.D. on Feb. 17, 2003, pp. 1–329.
Transcript of Deposition of Aris Silzars, Ph.D. on Feb. 20, 2003, pp. 1–272.
Transcript of Claim Construction Proceedings on Apr. 29–30, 2003, pp. 1–382.
Initial ITC Expert Report of Donald L. Bitzer, Ph.D., dated May 24, 2001 (redacted version).
Initial ITC Expert Report of Dr. Aris K. Silzars, dated May 24, 2001.
Initial ITC Expert Report of Mr. Dominick Monarchie, dated May 24, 2001.
Rebuttal ITC Expert Report of Donald L. Bitzer, Ph.D., dated Jun. 8, 2001 (redacted version).
Rebuttal ITC Expert Report of Dr. Aris K. Silzars, dated Jun. 8, 2001 (redacted version).
Rebuttal ITC Expert Report of Mr. Dominick Monarchie, dated Jun. 8, 2001 (redacted version).
The University's Literal Infringement and Validity Disclosures; Case No. C02–01673 (Sep. 18, 2003).
Validity Expert Report of Dr. L. Britzer; Case No. C02–01673 (Dec. 11, 2003).
Expert Declaration of Dr. Aris Silzars Regarding Motions for Summary Judgment; Case No. C02–01673 (Jan. 15, 2004).
The University of Illinois' Opposition to Defendants' Consolidated Motions for Summary Judgment of Invalidity and Non–Infringement of Claims of the '400 Patent; Case No. C02–01673 (Feb. 13, 2004).
Decl. of Donald L. Bitzer I/S/O Motions for SJ of Invalidigty and Non–Infringement of Claims in the '400 Patent; Case No. C02–01673 (Feb. 13, 2004).
Decl. of Karl J. Kramer I/S/O Reply I/S/O Motions for SJ of Invalidity and Non–Infringement of Claims of the '400 Patent; Case No. C02–01673 (Feb. 26, 2004).
Futjitsu's Motions for Summary Judgment of Invalidity and Non–Infringement of Claims of the '400 Patent; Case No. C02–01673 (Apr. 2, 2004).
Defs' Reply I/S/O Motions for Summary Judgment of Invalidity and Non–Infringement of Claims of the '400 Patent; Case No. C02–01673 (Apr. 20, 2004).
Order by Magistrate Judge Joseph C. Spero in *Competitive Technologies* v. *Fujitsu Ltd.,* dated Jul. 1, 2004 (42 pages).
University of Illinois' Nonconfidential Appeal Brief; dated Jun. 24, 2005; 94 pages.
Fijitsu's Nonconfidential Opposition Brief; dated Sep. 7, 2005; 73 pages.
H. Matsuzaki et al., "Technical Report of the Institute of Television Engineers, Electronic Device Image Display," vol. 7, No. 29 (Nov. 1983 in Japan).
M. L. Higgins; "A Low–Power Drive Scheme for AC TFEL Displays," SID International Symposium Digest of Technical Papers, vol. 16, pp. 226–228 (1985).

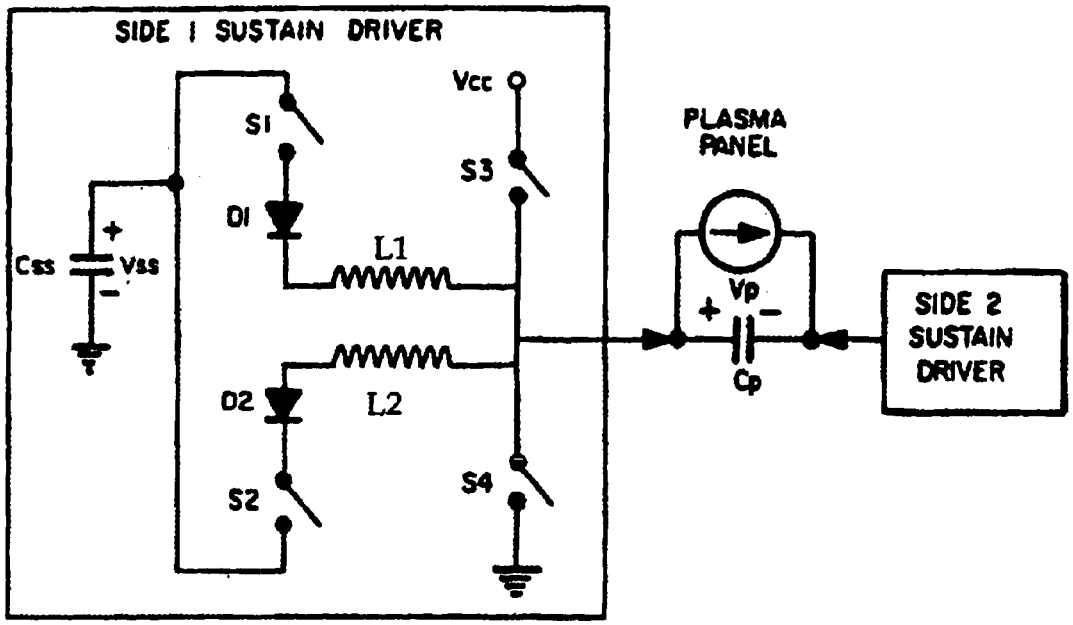
FIG. 5A (NEW)

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 24–26:

It is therefore desired to reduce the cost of plasma panel [reduction] *production* by reducing the cost by the associated electronics.

Column 3, lines 5–7:

FIG. 5 is a schematic circuit diagram showing an ideal model of a new sustain driver according to the invention *and FIG. 5A illustrates an exemplary sustain driver using inductors for charging and discharging*;

Column 9, line 62 through Column 10, line 9:

An ideal sustain driver circuit will be presented first to show the basic operation of the new sustain driver, given ideal components. As would be expected, given ideal components, this circuit has 100% recovery efficiency in charging and discharging a capacitive load. The schematic of the ideal sustain driver circuit is shown in FIG. 5, and in FIG. 6 are shown the output voltage and inductor current waveform expected for this circuit as the four switches are opened and closed through the four switching states. *A schematic of an exemplary sustain driver circuit using inductors L1 and L2 for charging and discharging is shown in FIG. 5A.* The operation during these four switching states is explained in detail below, where it is assumed that prior to State 1, Vss is at Vcc/2 (where Vcc is the sustain power supply voltage), Vp is at zero, S1 and S3 are open, and S2 and S4 are closed. The reason that V.sub.s s is at Vcc/2 will be explained, below, after the switching operation is explained:

Column 11, lines 30–42:

State 2. S3 is closed to clamp Vp at Vcc. (Notice that before S3 closes Vp has not completely risen to Vcc, due to the damping that was caused by R1, Rd1, and $R_L$. Thus, when S3 is closed, Vp is pulled [p] *up* to Vcc through S3, and a small amount of overshoot [cold] could occur if there were stray inductances present in the real circuit. This overshoot is shown in the waveform for Vp in FIG. 8). $I_L$ then becomes negative as C2 and Cd1 ($V_L$–V1) both rise from zero to Vss, at which point Dc2 becomes forward biased and I2 begins to flow. The energy in the inductor, when I2 begins to flow, is then ½(C2+Cd1)$Vss^2$. This energy is dissipated in $R_L$, Rd2, and R3 as I2 falls to zero.

Column 11, lines 54–68:

State 4. S4 is closed to clamp Vp at ground. (Notice that before S4 closes, Vp has not completely fallen to ground, due to the damping that was caused by R2, Rd2, and $R_L$. Thus, when S4 is closed, Vp is pulled down to ground through S4, and a small amount of undershoot could occur if there were stray inductances present in the real circuit. This undershoot is shown in the waveform for Vp in FIG. 8.)

$I_L$ then becomes positive as [CC1] *C1* and Cd2 are charged from the inductor. The voltages across C1 (Vss–V1) and across Cd2 (V2–[VL] $V_L$) both rise from zero to Vss, at which point Dc1 becomes forward biased and I1 begins to flow. The energy in the inductor when I1 begins to flow is then ½(C1+Cd2)$Vss^2$. This energy is dissipated in $R_L$, Rd1, and R4 as I1 falls to zero.

THE DRAWING FIGURES HAVE BEEN CHANGED AS FOLLOWS:

New FIG. 5A added.

AS A RESULT OF REEXAMINATION, IT HAS BEEN DETERMINED THAT:

The patentability of claims 1–20, 33, 34, 36 and 37 is confirmed.

Claims 21–25, 27–31, 35 and 38 are cancelled.

Claims 26, 32 and 39–41 are determined to be patentable as amended.

New claims 42–126 are added and determined to be patentable.

26. [The method of claim 25] *In display panels having panel electrodes and corresponding panel capacitance, an energy efficient method of driving said display panels through an inductor coupled to the panel electrodes comprising the steps of:*

*charging the panel capacitance through said inductor, initially while storing energy in said inductor until the magnitude of the inductor current reaches a maximum, and secondly while removing the stored energy from said inductor until the inductor current reaches zero; and*

*discharging the panel capacitance through said inductor, initially while storing energy in said inductor until the magnitude of the inductor current reaches a maximum, and secondly while removing the stored energy from said inductor until the inductor current reaches zero;*

*including the steps of after charging the panel capacitance, maintaining the panel capacitance in a charged state prior to discharge, and after discharge, maintaining the panel capacitance in a discharged state prior to again charging the panel capacitance*, wherein the step of maintaining the panel capacitance in a charged state includes clamping the voltage level of the panel capacitance upon the inductor current reaching zero, and wherein the step of maintaining the panel capacitance in a discharged state prior to again charging includes clamping the voltage level of the panel capacitance upon the inductor current reaching zero.

32. [A display panel according to claim 31] *A display panel having panel electrodes and panel capacitance, an inductor coupled to the panel electrodes, and a driver circuit coupled to the inductor for operating the display panel through the inductor, the driver circuit including,*

*means for charging the panel capacitance through said inductor, initially while storing energy in said inductor until the magnitude of the inductor current reaches a maximum, and secondly while removing the stored energy from said inductor until the inductor current reaches zero;*

*means for discharging the panel capacitance through said inductor, initially while storing energy in said inductor until the magnitude of the inductor current reaches a maximum, and secondly while removing the stored energy from said inductor until the inductor current reaches zero; and*

*means for maintaining the panel capacitance in a charged state after charging the panel capacitance and prior to discharge, and means for maintaining the panel capacitance in a discharged state after discharge and prior to again charging the panel capacitance*, wherein said means for maintaining the panel capacitance in a charged state includes means for [charging] *clamping* the voltage level of the panel capacitance upon the inductor current reaching zero during charging of the panel capacitance, and wherein said means for maintaining the panel capacitance in a discharged state includes means for clamping the voltage level of the panel capacitance upon the inductor current reaching zero during discharging of the panel capacitance.

39. An energy efficient driver [according to claim 38, including] *circuit for driving display panels having panel electrodes and panel capacitance, said driver circuit comprising:*

*an inductor coupled to said panel electrodes for charging and discharging said panel capacitance respectively to and from a desired voltage level magnitude;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor;*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor; and* third switch means coupled to said inductor for clamping the panel capacitance voltage level to maintain a panel capacitance discharged state until the panel capacitance is again charged.

40. An energy efficient driver [according to claim 38, including] *circuit for driving display panels having panel electrodes and panel capacitance, said driver circuit comprising:*

*an inductor coupled to said panel electrodes for charging and discharging said panel capacitance respectively to and from a desired voltage level magnitude;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor;*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor; and* third switch means coupled to said inductor *for* clamping the panel capacitance voltage to said desired voltage level magnitude after charging of said panel capacitance, and fourth switch means coupled to said inductor for clamping the panel capacitance voltage to said first voltage level magnitude after discharging of said panel capacitance.

41. An energy efficient driver [according to claim 40] *circuit for driving display panels having panel electrodes and panel capacitance, said driver circuit comprising:*

*an inductor coupled to said panel electrodes for charging and discharging said panel capacitance respectively to and from a desired voltage level magnitude;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor;*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor; and*

*third switch means coupled to said inductor for clamping the panel capacitance voltage to said desired voltage level magnitude after charging of said panel capacitance, and fourth switch means coupled to said inductor for clamping the panel capacitance voltage to said first voltage level magnitude after discharging of said panel capacitance*, wherein said third switch means and said fourth switch means each respectively includes means responsive to the end of the removal of said stored energy from said inductor to provide said respective clamping independent of variations in the value of said inductor or said panel capacitance.

*42. An AC plasma display panel having panel capacitance, and comprising:*

*panel electrodes;*

*an inductor coupled to said panel electrodes; and*

*a sustain driver circuit coupled to said inductor for operating said AC plasma display panel through the inductor, the sustain driver circuit comprising:*

*means for charging the panel capacitance through said inductor, initially while storing energy in said inductor until the magnitude of the inductor current reaches a maximum, and secondly while removing the stored energy from said inductor until the inductor current reaches zero, wherein said means for charging the panel capacitance includes at least one free-standing capacitor;*

*means for maintaining the panel capacitance in a charged state at approximately the time the inductor current reaches zero prior to discharge, wherein said means for maintaining the panel capacitance in a charged state includes a switched electrical connection to a fixed bias;*

*means for discharging the panel capacitance through said inductor, initially while storing energy in said inductor until the magnitude of the inductor current reaches a maximum, and secondly while removing the stored energy from said inductor until the inductor current reaches zero, wherein said means for discharging the panel capacitance includes at least one free-standing capacitor; and*

*means for maintaining the panel capacitance in a discharged state at approximately the time the inductor current reaches zero prior to again charging the panel capacitance, wherein said means for maintaining the panel capacitance in a discharged state includes a switched electrical connection to a fixed bias.*

*43. An AC plasma display panel according to claim 42, wherein said inductor at least includes a first inductor for charging said panel capacitance and a second inductor for discharging said panel capacitance.*

*44. An energy efficient driver circuit for driving AC plasma display panels comprising:*

*panel electrodes and panel capacitance,*

*said driver circuit comprising:*

*an inductor coupled to said panel electrodes for charging and discharging said panel capacitance to and from a desired voltage level magnitude;*

*a free-standing capacitor for applying forcing voltages during said charging and discharging;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor;*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor;*

*third switch means for clamping the panel capacitance voltage to said desired voltage level magnitude after said panel capacitance is substantially charged; and*

*fourth switch means for clamping the panel capacitance voltage to said first voltage level magnitude after said panel capacitance is substantially discharged.*

*45. An energy efficient driver circuit for driving AC plasma display panels according to claim 44, wherein said inductor at least includes a first inductor for charging said panel capacitance and a second inductor for discharging said panel capacitance.*

*46. The method of claim 21, further comprising clamping the voltage level of the panel capacitance to the voltage level of said first voltage source through said first switch coupled to said first voltage source.*

*47. The method of claim 46, further comprising activating said first switch approximately when said panel capacitance is substantially charged.*

*48. The method of claim 47, further comprising activating said first switch when the current in said inductor approximately equals zero.*

*49. The method of claim 48, further comprising activating said first switch in response to the inductor current reaching zero.*

*50. The method of claim 21, further comprising clamping the voltage level of the panel capacitance to the voltage level of said second voltage source through said second switch coupled to said second voltage source.*

*51. The method of claim 50, further comprising activating said second switch when the current in said inductor approximately equals zero.*

*52. The method of claim 51, further comprising activating said second switch in response to the inductor current reaching zero.*

*53. The method of claim 21, further comprising providing a gas discharge current to said panel through said first switch.*

*54. The method of claim 21, wherein said inductor at least includes a first inductor for charging said panel capacitance and a second inductor for discharging said panel capacitance.*

*55. An energy efficient driver circuit for driving display panels having panel electrodes and panel capacitance, said driver circuit comprising:*

*an inductor coupled to said panel electrodes for charging and discharging said panel capacitance respectively to and from a desired voltage level magnitude;*

*a free-standing capacitor coupled to said inductor;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor; and*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor.*

*56. The driver circuit of claim 55, further comprising a switch coupled to said panel capacitance and to a first voltage source.*

*57. The driver circuit of claim 56, wherein said first voltage source charges the panel capacitance to the voltage level of said first voltage source.*

*58. The driver circuit of claim 57, wherein said first voltage source clamps the panel capacitance to said voltage level of said first voltage source after charging the panel capacitance to said voltage level of said first voltage source.*

*59. The driver circuit of claim 56, wherein the voltage level of said first voltage source is approximately equal to twice the voltage of said free-standing capacitor.*

*60. The driver circuit of claim 56, wherein said switch is activated approximately when the inductor current reaches zero.*

*61. The driver circuit of claim 60, further comprising means for activating said switch in response to the inductor current reaching approximately zero.*

*62. In display panels having panel electrodes and corresponding panel capacitance, an energy efficient method of*

*driving said display panels through an inductor coupled to the panel electrodes and to a free-standing capacitor comprising the steps of:*

*charging the panel capacitance through said inductor coupled to said free-standing capacitor, initially while storing energy in said inductor until the magnitude of the inductor current reaches a maximum, and secondly while removing the stored energy from said inductor until the inductor current reaches zero; and*

*discharging the panel capacitance through said inductor coupled to said free-standing capacitor, initially while storing energy in said inductor until the magnitude of the inductor current reaches a maximum, and secondly while removing the stored energy from said inductor until the inductor current reaches zero.*

*63. The method of claim 62, further comprising clamping said panel capacitance in a charged state by a first switch coupled to a first power source.*

*64. The method of claim 63, further comprising charging said panel capacitance to a first voltage level through said first switch coupled to said first power source.*

*65. The method of claim 63, wherein the voltage level of said first power source is approximately equal to twice the voltage level of said free-standing capacitor.*

*66. The method of claim 63, further comprising activating said first switch approximately when the panel capacitance is substantially charged.*

*67. The method of claim 66, further comprising activating said first switch in response to the inductor current reaching approximately zero.*

*68. The method of claim 67, further comprising clamping said panel capacitance in a discharged state by a second switch coupled to a second power source.*

*69. The method of claim 68, further comprising discharging said panel capacitance through said second switch coupled to said second power source.*

*70. The method of claim 62, wherein said inductor at least includes a first inductor for charging said panel capacitance and a second inductor for discharging said panel capacitance.*

*71. An energy efficient driver circuit for driving display panels having panel electrodes and panel capacitance, said driver circuit comprising:*

*an inductor coupled to said panel electrodes for charging and discharging said panel capacitance respectively to and from a desired voltage level magnitude;*

*capacitors coupled to said inductor and to a first voltage source and a second voltage source in a voltage divider circuit;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor; and*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor.*

*72. The driver circuit of claim 71, further comprising a switch coupled to said first voltage source and to said panel capacitance.*

*73. The driver circuit of claim 72, wherein said first voltage source charges said panel capacitance together with said charging the panel capacitance through said inductor.*

*74. The driver circuit of claim 73, wherein said switch is closed at approximately the time when the inductor current reaches zero.*

*75. The driver circuit of claim 74, wherein said switch is closed in response to the inductor current reaching approximately zero.*

*76. The driver circuit of claim 75, further comprising means responsive to the inductor current reaching approximately zero for closing said switch.*

*77. In display panels having panel electrodes and corresponding panel capacitance, an energy efficient method of driving said display panels through an inductor coupled to the panel electrodes comprising the steps of:*

*charging the panel capacitance through said inductor, initially while storing energy in said inductor until the magnitude of the inductor current reaches a maximum, and secondly while removing the stored energy from said inductor until the inductor current reaches zero, said charging occurring through capacitors configured in a voltage divider configuration; and*

*discharging the panel capacitance through said inductor, initially while storing energy in said inductor until the magnitude of the inductor current reaches a maximum, and secondly while removing the stored energy from said inductor until the inductor current reaches zero.*

*78. The method of claim 77, wherein discharging the panel capacitance through said inductor comprises discharging the panel capacitance through capacitors configured in a voltage divider configuration.*

*79. The method of claim 77, wherein said capacitors configured in a voltage divider configuration apply a forcing voltage to said inductor, said forcing voltage being equal to approximately one-half the voltage of a first voltage source.*

*80. The method of claim 79, further comprising charging said panel capacitance through said first voltage source in addition to said charging through said inductor, said first voltage source being coupled to said panel capacitance through a first switch.*

*81. The method of claim 80, further comprising clamping said panel capacitance through said first voltage source.*

*82. The method of claim 77, further comprising maintaining said panel capacitance in a charged state through a first diode.*

*83. The method of claim 77, further comprising maintaining said panel capacitance in a discharged state through a second diode.*

*84. In plasma display panels having panel electrodes and corresponding panel capacitance, an energy efficient method of driving a sustain circuit of said display panels through an inductor coupled to the panel electrodes, comprising the steps of:*

*charging the panel capacitance through said inductor, initially while storing energy in said inductor until the magnitude of the inductor current reaches a maximum, and secondly while removing the stored energy from said inductor until the inductor current reaches zero;*

*charging the panel capacitance to a first desired voltage level through a first switch coupled to a first voltage source;*

*maintaining the panel capacitance at said first desired voltage level through said first switch coupled to said first voltage source and a first diode;*

*discharging the panel capacitance through said inductor, initially while storing energy in said inductor until the*

*magnitude of the inductor current reaches a maximum, and secondly while removing the stored energy from said inductor until the inductor current reaches zero;*

*discharging the panel capacitance to approximately zero volts across the panel capacitance through a second switch coupled to a second voltage source; and*

*maintaining the panel capacitance at approximately a discharged state through said second switch coupled to said second voltage source and a second diode.*

*85. The method of claim 84, wherein charging the panel capacitance through said inductor comprises applying a forcing voltage to said inductor, said forcing voltage being approximately equal to one-half the difference between the voltages of said first voltage source and said second voltage source.*

*86. The method of claim 84, further comprising providing a gas discharge current through said first switch.*

*87. The method of claim 84, wherein charging the panel capacitance to a first desired voltage level through a first switch coupled to a first voltage source comprises closing said first switch at about the time when the panel capacitance is substantially charged.*

*88. The method of claim 87, wherein charging the panel capacitance to a first desired voltage level through a first switch coupled to a first voltage source comprises closing said first switch at about the time when the inductor current reaches zero.*

*89. The method of claim 88, wherein charging the panel capacitance to a first desired voltage level through a first switch coupled to a first voltage source comprises closing said first switch in response to the inductor current reaching zero.*

*90. The method of claim 84, wherein said inductor at least includes a first inductor for charging said panel capacitance and a second inductor for discharging said panel capacitance.*

*91. In display panels having panel electrodes and corresponding panel capacitance, an energy efficient method of driving said display panels through an inductor coupled to the panel electrodes comprising the steps of:*

*charging the panel capacitance through said inductor by applying a forcing voltage to said inductor, initially while storing energy in said inductor until the magnitude of the inductor current reaches a maximum, and secondly while removing the stored energy from said inductor until the inductor current reaches zero;*

*clamping the voltage across said panel capacitance to maintain the voltage at approximately a first voltage level through a first closed switch coupled to a first voltage source;*

*discharging the panel capacitance through said inductor by applying said forcing voltage to said inductor, initially while storing energy in said inductor until the magnitude of the inductor current reaches a maximum, and secondly while removing the stored energy from said inductor until the inductor current reaches zero; and*

*clamping the voltage across said panel capacitance to maintain the voltage at approximately a second voltage level through a second closed switch coupled to a second voltage source, wherein said forcing voltage is approximately equal to one-half the difference between the voltages of the first voltage source and the second voltage source.*

*92. The method of claim 91, further comprising charging the panel capacitance through said first closed switch coupled to said first voltage source, said charging occurring prior to clamping the voltage across said panel capacitance to maintain the voltage at approximately said first voltage level.*

*93. The method of claim 92, further comprising activating said first closed switch in response to the inductor current reaching approximately zero.*

*94. The method of claim 93, further comprising activating said second closed switch in response to the inductor current reaching approximately zero.*

*95. The method of claim 91, further comprising discharging the panel capacitance through said second closed switch coupled to said second voltage source, said discharging occurring prior to clamping the voltage across said panel capacitance to maintain the voltage at approximately said second voltage level.*

*96. The method of claim 91, wherein applying a forcing voltage comprises applying a forcing voltage using a capacitor.*

*97. The method of claim 96, wherein applying a forcing voltage comprises applying a forcing voltage using a free-standing capacitor.*

*98. The method of claim 91, wherein said inductor at least includes a first inductor for charging said panel capacitance and a second inductor for discharging said panel capacitance.*

*99. A plasma display panel having panel electrodes and panel capacitance, comprising:*

*an inductor coupled to the panel electrodes; and*

*a sustain driver circuit coupled to the inductor for operating the display panel through the inductor, the sustain driver circuit including,*

*means for charging the panel capacitance through said inductor, initially while storing energy in said inductor until the magnitude of the inductor current reaches a maximum, and secondly while removing the stored energy from said inductor until the inductor current reaches zero; and*

*a first switch coupled to said panel capacitance and to a first voltage source, said first switch for enabling charging of said panel capacitance to said first voltage source in addition to said charging through said inductor;*

*means for discharging the panel capacitance through said inductor, initially while storing energy in said inductor until the magnitude of the inductor current reaches a maximum, and secondly while removing the stored energy from said inductor until the inductor current reaches zero;*

*a second switch coupled to said panel capacitance and to a second voltage source, said second switch for enabling discharging of the panel capacitance to a second voltage source voltage source in addition to said discharging through said inductor.*

*100. The plasma display panel of claim 99, further comprising a first diode for maintaining said panel capacitance at said first voltage source.*

*101. The plasma display panel of claim 99, further comprising a second diode for maintaining said panel capacitance at said second voltage source.*

*102. The plasma display panel of claim 99, wherein said first switch is activated when the panel capacitance is substantially charged through said inductor.*

*103. The plasma display panel of claim 102, wherein said first switch is activated when the inductor current reaches approximately zero.*

*104. The plasma display panel of claim 103, further comprising means for activating said first switch in response to the inductor current reaching approximately zero.*

*105. The plasma display panel of claim 99, wherein said first voltage source clamps said panel capacitance in a charged state.*

*106. The plasma display panel of claim 99, wherein said second voltage source clamps said panel capacitance in a discharged state.*

*107. The plasma display panel of claim 99, wherein said inductor at least includes a first inductor for charging said panel capacitance and a second inductor for discharging said panel capacitance.*

*108. A display panel having panel electrodes and panel capacitance, comprising:*

*an inductor coupled to the panel electrodes;*

*a first switch coupled to a first voltage source and to said panel capacitance;*

*a second switch coupled to a second voltage source and to said panel capacitance; and*

*a driver circuit coupled to the inductor for operating the display panel through the inductor, the sustain driver circuit including,*

*means for charging the panel capacitance through said inductor, initially while storing energy in said inductor until the magnitude of the inductor current reaches a maximum, and secondly while removing the stored energy from said inductor until the inductor current reaches zero, said means for charging comprising means for applying a forcing voltage which is approximately equal to one-half the difference between the voltages of said first voltage source and said second voltage source; and*

*means for discharging the panel capacitance through said inductor, initially while storing energy in said inductor until the magnitude of the inductor current reaches a maximum, and secondly while removing the stored energy from said inductor until the inductor current reaches zero.*

*109. The display panel of claim 108, wherein said first voltage source charges said panel capacitance to a first voltage level.*

*110. The display panel of claim 109, wherein said first voltage source clamps said panel capacitance to said first voltage level approximately when said panel capacitance is charged to said first voltage level.*

*111. The display panel of claim 110, wherein said first switch is activated at approximately the time when the inductor current reaches zero.*

*112. The display panel of claim 111, wherein said first switch is activated in response to the inductor current reaching approximately zero.*

*113. The display panel of claim 112, further comprising control means for activating said first switch in response to the inductor current reaching approximately zero.*

*114. The plasma display panel of claim 108, wherein said inductor at least includes a first inductor for charging said panel capacitance and a second inductor for discharging said panel capacitance.*

*115. In display panels having panel electrodes and corresponding panel capacitance, an energy efficient method of driving said display panels through an inductor coupled to the panel electrodes comprising the steps of:*

*applying a forcing voltage to said inductor, said forcing voltage being equal to approximately one-half the magnitude of the voltage level of a first voltage source, said first voltage source being coupled to a first switch coupled to the panel capacitance;*

*charging the panel capacitance through said inductor, initially while storing energy in said inductor until the magnitude of the inductor current reaches a maximum, and secondly while removing the stored energy from said inductor until the inductor current reaches zero;*

*charging the panel capacitance to the voltage level of said first voltage source through said first switch coupled to said first voltage source, said charging the panel capacitance to the voltage level of said first voltage source occurring in addition to said charging of the panel capacitance through said inductor;*

*discharging the panel capacitance through said inductor, initially while storing energy in said inductor until the magnitude of the inductor current reaches a maximum, and secondly while removing the stored energy from said inductor until the inductor current reaches zero; and*

*discharging the panel capacitance to the voltage level of a second voltage source through a second switch coupled to said second voltage source, said discharging the panel capacitance to the voltage level of said second voltage source occurring in addition to said discharging of the panel capacitance through said inductor.*

*116. The method of claim 115, wherein applying a forcing voltage to said inductor includes applying a forcing voltage which is about one-half the magnitude of the voltage level the panel capacitance reaches after charging.*

*117. The method of claim 116, wherein discharging of the panel capacitance includes applying a forcing voltage which is about one-half the magnitude of the voltage level the panel capacitance reaches after charging.*

*118. The method of claim 115, including the step of after discharging the panel capacitance, maintaining the panel capacitance in a discharging state prior to again charging the panel capacitance.*

*119. The method of claim 115, including the steps of after charging the panel capacitance, maintaining the panel capacitance in a charged state prior to discharge, and after discharge, maintaining the panel capacitance in a discharged state prior to again charging the panel capacitance.*

*120. A display panel having panel electrodes and panel capacitance, an inductor coupled to the panel electrodes, and a sustain driver circuit coupled to the inductor for operating the display panel through the inductor, the sustain driver circuit including,*

*means for charging the panel capacitance through said inductor, initially while storing energy in said inductor until the magnitude of the inductor current reaches a maximum, and secondly while removing the stored energy from said inductor until the inductor current reaches zero;*

*said means for charging including one of (a) at least one capacitor, said capacitor not being the output capacitor of a regulated power supply and (b) capacitors configured in a voltage divider circuit; and*

*means for discharging the panel capacitance through said inductor, initially while storing energy in said inductor until the magnitude of the inductor current reaches a maximum, and secondly while removing the stored energy from said inductor until the inductor current reaches zero.*

*121. A display panel according to claim 120, wherein said means for charging the panel capacitance includes means for applying a forcing voltage which is about one-half the magnitude of the voltage level the panel capacitance reaches after charging.*

*122. A display panel according to claim 121, wherein said means for discharging the panel capacitance includes*

*means for applying a forcing voltage which is about one-half the magnitude of the voltage level the panel capacitance reaches after charging.*

*123. A display panel according to claim 120, including means for maintaining the panel capacitance in a discharged state upon the inductor current reaching zero and prior to again charging the panel capacitance.*

*124. A display panel according to claim 120, including means for maintaining the panel capacitance in a charged state after charging the panel capacitance and prior to discharge, and means for maintaining the panel capacitance in a discharged state after discharge and prior to again charging the panel capacitance.*

*125. An energy efficient sustain driver circuit for driving display panels having panel electrodes and panel capacitance, said sustain driver circuit comprising:*

*an inductor coupled to said panel electrodes for charging and discharging the panel capacitance;*

*means for charging the panel capacitance through said inductor, initially while storing energy in said inductor until the magnitude of the inductor current reaches a maximum, and secondly while removing the stored energy from said inductor until the inductor current reaches zero;*

*said means for charging including one of (a) at least one capacitor, said capacitor not being the output capacitor of a regulated power supply and (b) capacitors configured in a voltage divider circuit; and*

*means for discharging the panel capacitance through said inductor, initially while storing energy in said inductor until the magnitude of the inductor current reaches a maximum, and secondly while removing the stored energy from said inductor until the inductor current reaches zero.*

*126. An energy efficient driver circuit for driving display panels having panel electrodes and panel capacitance, said driver circuit comprising:*

*an inductor coupled to said panel electrodes for charging and discharging said panel capacitance respectively to and from a desired voltage level magnitude;*

*means for applying a forcing voltage to said inductor, said forcing voltage being equal to approximately one-half the magnitude of the voltage level of a first voltage source, said first voltage source being coupled to a switch coupled to the panel capacitance;*

*first switch means coupled to said inductor to enable said panel capacitance to charge through said inductor from a first voltage level (a) initially to an intermediate voltage level magnitude which is about one-half the desired voltage level magnitude, while storing energy in said inductor, and (b) then to said desired voltage level magnitude, while removing said stored energy from said inductor; and*

*second switch means coupled to said inductor to enable said panel capacitance to discharge through said inductor from said desired voltage level magnitude (a) initially to an intermediate voltage level magnitude which is about one-half the desired voltage level magnitude, while storing energy in said inductor, and (b) then to said first voltage level magnitude, while removing said stored energy from said inductor.*

* * * * *

US005081400C2

(12) EX PARTE REEXAMINATION CERTIFICATE (6531st)

United States Patent

Weber et al.

(10) Number: US 5,081,400 C2

(45) Certificate Issued: Nov. 18, 2008

(54) POWER EFFICIENT SUSTAIN DRIVERS AND ADDRESS DRIVERS FOR PLASMA PANEL

(75) Inventors: Larry F. Weber, Champaign, IL (US); Kevin W. Warren, Champaign, IL (US); Mark B. Wood, Woods Cross, UT (US)

(73) Assignee: The Board of Trustees of the University of Illinois, Urbana, IL (US)

Reexamination Request:
No. 90/008,166, Aug. 16, 2006

Reexamination Certificate for:

| | |
|---|---|
| Patent No.: | **5,081,400** |
| Issued: | **Jan. 14, 1992** |
| Appl. No.: | **07/338,111** |
| Filed: | **Apr. 14, 1989** |

Reexamination Certificate C1 5,081,400 issued Mar. 6, 2007

Certificate of Correction issued Aug. 17, 1993.

Related U.S. Application Data

(63) Continuation of application No. 06/911,396, filed on Sep. 25, 1986, now Pat. No. 4,866,349.

(51) Int. Cl.

| | |
|---|---|
| ***G09G 3/10*** | (2006.01) |
| ***G09G 3/22*** | (2006.01) |
| ***G09G 3/28*** | (2006.01) |

(52) U.S. Cl. ..... 315/169.4; 315/169.3; 315/169.1; 315/209 R; 315/242; 345/208; 345/204; 345/214; 345/76

(58) Field of Classification Search ..... None
See application file for complete search history.

(56) References Cited

U.S. PATENT DOCUMENTS 3,780,339 A 12/1973 Mayle
4,707,692 A 11/1987 Higgins et al.

FOREIGN PATENT DOCUMENTS

JP S51-71730 6/1976
JP S52-95156 8/1977

OTHER PUBLICATIONS

"Lessons in Electric Circuits—vol. II, Chapter 6 Resonance" Retrieved from the Internet on Mar. 13, 2008, http://www.ibiblio.org/kuphaldt/electricCircuits/AC/AC_6.html, copyright 2000–2008.*

H. Matsuzaki et al., "Technical Report of the Institute of Television Engineers, Electronic Device Image Display," vol. 7, No. 29 (Nov. 1983 in Japan).

M. L. Hoggins, "A Low–Power Drive Scheme for AC TFEL Displays," SID International Symposium Digest of Technical Papers, vol. 16, pp. 226–228 (1985).

* cited by examiner

*Primary Examiner*—Fritz M Fleming

(57) ABSTRACT

An improved address driver circuit for plasma panels, particularly useful with an independent sustain and address plasma panel. Address pulse generators for one panel address axis are coupled to MOSFET driver devices and provide pulses of a first polarity; and address pulse generators for the other panel address axis are coupled to similar MOSFET driver devices and provide double pulses of a second polarity. With N-channel open-drain MOSFET drivers on both panel address axes, they only need to be designed to pull low. An improved power efficient sustain driver for plasma panels including an inductor through which the panel capacitance is charged and discharged, and switch means switched when the inductor current is zero, which permits recovery of the energy otherwise lost in driving the panel capacitance. An independent sustain and address plasma panel with such energy efficient address drivers and sustain drivers. The energy efficient sustain driver can be used with plasma display panels, electroluminescent panels and with liquid crystal panels having inherent panel capacitance. An independent sustain and address panel with N-channel MOSFET drivers on one address axis and P-channel MOSFET drivers on the other address axis, with an address pulse generator providing pulses of a first polarity to the N-channel MOSFETs, and another address pulse generator providing pulses of a second polarity to the P-channel MOSFETS.

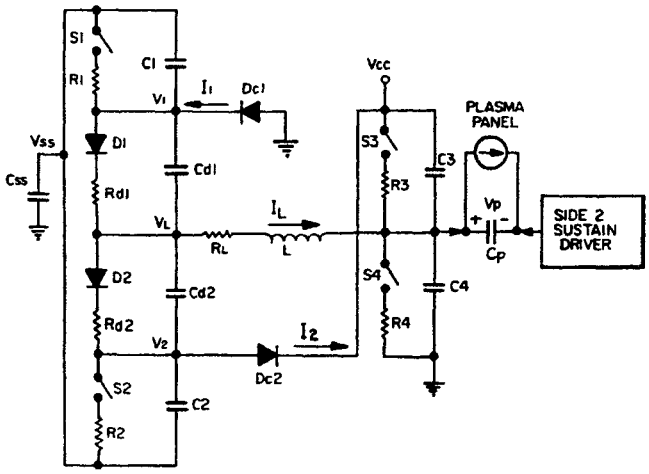

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 21–25, 27–31, 35 and 38 were previously cancelled.

Claims 26, 32, 33, 36, 39 and 40 are cancelled.

Claims 1–20, 34, 37 and 41–126 were not reexamined.

* * * * *